US011326371B2

(12) United States Patent
Middelaer et al.

(10) Patent No.: US 11,326,371 B2
(45) Date of Patent: May 10, 2022

(54) TOOL FOR USE WITH ADJUSTABLE BACKSET LATCH

(71) Applicant: Yale Security Inc., Monroe, NC (US)

(72) Inventors: William S. Middelaer, Simsbury, CT (US); Christopher Hill, New Britain, CT (US); Todd Zimmer, Meriden, CT (US); Brian R. Fournier, Canton, CT (US); Christine E. Voelker, East Hampton, CT (US)

(73) Assignee: ASSA ABLOY Access and Egress Hardware Group, Inc., Berlin, CT (US)

( * ) Notice: Subject to any disclaimer, the term of this patent is extended or adjusted under 35 U.S.C. 154(b) by 1123 days.

(21) Appl. No.: 15/881,047

(22) Filed: Jan. 26, 2018

(65) Prior Publication Data

US 2018/0216368 A1 Aug. 2, 2018

Related U.S. Application Data

(60) Provisional application No. 62/453,253, filed on Feb. 1, 2017.

(51) Int. Cl.
*E05B 63/06* (2006.01)
*E05B 55/00* (2006.01)

(52) U.S. Cl.
CPC ..... *E05B 63/06* (2013.01); *E05B 55/005* (2013.01)

(58) Field of Classification Search
CPC ..... E05B 63/06; E05B 65/06; E05B 55/005; Y10T 292/06; Y10T 292/062;
(Continued)

(56) References Cited

U.S. PATENT DOCUMENTS 1,701,790 A 2/1929 Morin, Jr.
2,175,791 A 10/1939 Brauning
(Continued)

FOREIGN PATENT DOCUMENTS

CN 101666179 A * 3/2010 ..... E05B 63/06
GB 2115053 A 9/1983
(Continued)

OTHER PUBLICATIONS http://www.google.com/products?q=adjustable+lockset&h1=en&rls=RNWE,RNWE: 2006-19,RNWEen& . . . ; dated Aug. 30, 2007, (3 pages).
(Continued)

*Primary Examiner* — Alyson M Merlino
(74) *Attorney, Agent, or Firm* — Jeffrey R. Gray; Moore & Van Allen PLLC

(57) ABSTRACT

A tool for adjusting the backset of a latch bolt. The latch bolt includes a latch bolt and a tailpiece. A housing receives the latch bolt and includes a transversely extending protrusion. A casing slidably receives the housing such that the protrusion on the housing is received in a slot on the casing and an inner end of the tailpiece extends from the housing and casing. The casing is rotated relative to the housing to allow relative axial movement between the casing and the housing when transitioning between the first backset position and the second backset position. The tool includes a member defining a first slot for receiving the inner end of the tailpiece and a pair of second slots for receiving the pair of ears such that rotation of the tool rotates the tailpiece and the casing simultaneously.

20 Claims, 23 Drawing Sheets

(58) Field of Classification Search
CPC ..... Y10T 292/096; Y10T 292/0969; Y10T 292/0977; Y10T 70/8541; Y10T 70/7655; Y10T 70/7667; Y10T 70/8459; Y10T 70/8486; Y10T 70/8514; E05C 1/08; E05C 1/005; E05C 1/12; E05C 1/16; E05C 1/163; Y10S 292/53; Y10S 292/54; Y10S 292/64; Y10S 292/60
See application file for complete search history.

(56) References Cited

U.S. PATENT DOCUMENTS

| | | | |
|---|---|---|---|
| 2,293,856 | A | 8/1942 | Schlage |
| 2,765,187 | A | 10/1956 | Crandell |
| 2,776,155 | A | 1/1957 | Gerlach |
| 3,046,042 | A | 7/1962 | Kane |
| 3,287,046 | A | 11/1966 | Russell et al. |
| 3,287,047 | A | 11/1966 | Russell et al. |
| 4,372,594 | A | 2/1983 | Gater |
| 4,428,212 | A | 1/1984 | Best et al. |
| 4,564,229 | A | 1/1986 | Mullich et al. |
| 4,593,542 | A | 6/1986 | Rotondi et al. |
| 4,602,490 | A | 7/1986 | Glass et al. |
| 4,623,174 | A | 11/1986 | Trull et al. |
| 4,639,025 | A | 1/1987 | Fann et al. |
| 4,653,787 | A | 3/1987 | Fang |
| 4,656,849 | A | 4/1987 | Rotondi et al. |
| 4,664,433 | A | 5/1987 | Solovieff |
| 4,708,379 | A | 11/1987 | Ching |
| 4,725,086 | A | 2/1988 | Shen |
| 4,729,585 | A | 3/1988 | Lin |
| 4,729,586 | A | 3/1988 | Fang |
| 4,732,594 | A | 3/1988 | Mizrah et al. |
| 4,736,973 | A | 4/1988 | Fang |
| 4,744,232 | A | 5/1988 | Shen |
| 4,752,090 | A | 6/1988 | Lin |
| 4,759,576 | A | 7/1988 | Ching |
| 4,767,140 | A | 8/1988 | Lin |
| 4,772,055 | A | 9/1988 | Fang |
| 4,796,931 | A | 1/1989 | Heid |
| 4,800,741 | A | 1/1989 | Kerschenbaum et al. |
| 4,804,216 | A | 2/1989 | Marotto |
| 4,840,412 | A | 6/1989 | Shen |
| 4,895,404 | A | 1/1990 | Toledano |
| 4,902,057 | A | 2/1990 | Ching |
| 4,921,290 | A | 5/1990 | Dietrich |
| 4,940,269 | A | 7/1990 | Kim |
| 4,976,122 | A | 12/1990 | Doolan et al. |
| 4,979,768 | A | 12/1990 | Marotto et al. |
| 5,152,558 | A | 10/1992 | Smith et al. |
| 5,169,184 | A | 12/1992 | Bishop |
| 5,246,258 | A | 9/1993 | Kerschenbaum et al. |
| 5,257,837 | A | 11/1993 | Bishop |
| 5,364,138 | A | 11/1994 | Dietrich et al. |
| 5,456,503 | A | 10/1995 | Russell, IV |
| 5,489,128 | A | 2/1996 | Florian |
| 5,501,492 | A | 3/1996 | Kajuch |
| 5,516,160 | A | 5/1996 | Kajuch |
| 5,562,314 | A | 10/1996 | Wheatland et al. |
| 5,570,912 | A | 11/1996 | Mullich |
| 5,613,715 | A | 3/1997 | Kim |
| 5,620,211 | A | 4/1997 | Ellis |
| 5,647,617 | A | 7/1997 | Kajuch |
| 5,713,612 | A | 2/1998 | Kajuch |
| 5,743,573 | A | 4/1998 | Huang |
| 5,957,510 | A | 9/1999 | Kuo |
| 6,131,970 | A | 10/2000 | Hurst et al. |
| 6,257,630 | B1 | 7/2001 | Huang |
| 6,293,597 | B1 | 9/2001 | Huang |
| 6,318,769 | B1 | 11/2001 | Kang |
| 6,334,635 | B1 | 1/2002 | Huang |
| 6,443,503 | B1 | 9/2002 | Fan Lu et al. |
| 6,536,812 | B1 | 3/2003 | Winardi |
| 6,540,274 | B2 | 4/2003 | Bates et al. |
| 6,553,799 | B2 | 4/2003 | Bates et al. |
| 6,662,603 | B2 | 12/2003 | Morris |
| 6,688,660 | B2 | 2/2004 | Huang |
| 6,793,254 | B1 | 9/2004 | Galvin |
| 6,802,546 | B2 | 10/2004 | Bates et al. |
| 6,837,526 | B2 | 1/2005 | Markbreit |
| 6,926,319 | B2 | 8/2005 | Bates et al. |
| 6,991,271 | B2 | 1/2006 | Chiang |
| 7,222,890 | B2 | 5/2007 | Yuan |
| 7,393,022 | B1 | 7/2008 | Shan et al. |
| 7,695,032 | B2 | 4/2010 | Bodily |
| 8,360,482 | B2 | 1/2013 | Viviano |
| 2001/0023600 | A1 | 9/2001 | Pompeii |
| 2002/0117866 | A1 | 8/2002 | Bates et al. |
| 2003/0075930 | A1 | 4/2003 | Mak |
| 2004/0212199 | A1 | 10/2004 | Huang |
| 2006/0006659 | A1 | 1/2006 | Yuan |
| 2006/0208509 | A1 | 9/2006 | Bodily |
| 2007/0052245 | A1 | 3/2007 | Bodily et al. |
| 2007/0052250 | A1 | 3/2007 | Bodily et al. |
| 2008/0084062 | A1 | 4/2008 | Krohn |
| 2008/0179892 | A1 | 7/2008 | Yuan |
| 2008/0210835 | A1 | 9/2008 | Bagnall |
| 2009/0152875 | A1 | 6/2009 | Gray et al. |
| 2010/0307207 | A1 | 12/2010 | Vogel et al. |
| 2016/0215525 | A1 | 7/2016 | Ramakrishna |
| 2017/0009490 | A1 | 1/2017 | Hill et al. |
| 2017/0275926 | A1 | 9/2017 | Kumar et al. |

FOREIGN PATENT DOCUMENTS

| | | | |
|---|---|---|---|
| TW | 322092 | B | 12/1997 |
| TW | 452625 | B | 9/2001 |
| WO | 0112930 | A1 | 2/2001 |
| WO | 2007001311 | A1 | 1/2007 |

OTHER PUBLICATIONS http://hardware.hardwarestore.com/29-437-latchbolts/spring-interior-adjustable-latch-639423.aspx?CAW . . . , dated Aug. 30, 2007, (2 pages).
http://hardware.hardwarestore.com/29-424-knobsets/polo-entry-6-adjustable-latch-k3-kwik-install-61629 . . . , dated Aug. 30, 2007, (2 pages).
http://www.doityourself.com/invt/u520742; dated Aug. 30, 2007, (2 pages).
http://www.doityourself.com/invt/u527630; dated Aug. 30, 2007, (2 pages).
http://www.doityourself.com/invt/u2686863; dated Aug. 30, 2007, (2 pages).
Yale Security Inc., International Patent Application No. PCT/US2008/086324; International Search Report and Written Opinion; dated Apr. 14, 2009.
Yale Security Inc., PCT International Preliminary Report on Patentability, for PCT Application No. PCT/US2008/086324, dated Jun. 24, 2010, 7 pages.
Yale Security, Inc., International Search Report and Written Opinion, PCT. Application No. PCT/US2010/033368, dated Oct. 18, 2010, 14 pages.
Yale Security Inc., Taiwanese Application No. 097148541, Office Action and Search Report dated Mar. 30, 2011, 7 pages.
International Bureau of WIPO; International Preliminary Report on Patentability for International Patent Application No. PCT/US2016/041267 dated Jan. 18, 2018, 13 Pages.
Yale Security Inc., International Application No. PCT/US2016/041267, International Search Report and Written Opinion, dated Sep. 16, 2016, 16 Pages.

* cited by examiner

TOOL FOR USE WITH ADJUSTABLE BACKSET LATCH

CROSS-REFERENCE

This application is related to U.S. provisional application No. 62/453,253, filed Feb. 1, 2017, entitled "TOOL FOR USE WITH ADJUSTABLE BACKSET LATCH", naming William S. Middelaer, Christopher Hill, Todd Zimmer, Brian R. Fournier, and Christine E. Voelker as the inventors. The contents of the provisional application are incorporated herein by reference in their entirety, and the benefit of the filing date of the provisional application is hereby claimed for all purposes that are legally served by such claim for the benefit of the filing date.

BACKGROUND

A tool is provided for a lockset including a latch assembly with an adjustable backset distance for use with doors having different backset distances.

Adjustable latch mechanisms for use at different backset distances are an accepted feature of cylindrical tubular locksets. "Backset" is the distance between the edge of a door and the transverse axis of rotation about which a latch operator moves for extending and retracting a latch bolt. Backset has been standardized by the industry, wherein standard backsets for commercial door openings are 2⅜ inches and 2¾ inches. Changing the backset of an adjustable backset bored lockset latch requires rotating a latch tail and an outer case, sliding the latch tail and outer case relative to an inner case to a different backset position, and then rotating the latch tail and the outer case again. Moving these several parts simultaneously can be difficult and requires some dexterity.

For the foregoing reasons, there is a need for a new tool for an adjustable backset lockset for easy adjustment of the latch backset prior to mounting on doors of differing backset distances. Ideally, the new tool would allow for relatively quick and easy selective adjustment between two different backset measurements.

SUMMARY OF THE INVENTION

A tool is provided for adjusting the backset of a latch bolt of the type comprising a latch bolt and a tailpiece. A housing slidably receives the latch bolt therein. The housing includes a transversely extending protrusion. A casing defines a peripheral slot having two axially spaced circumferential portions interconnected by a longitudinal portion. A pair of ears extend from the casing. The casing is configured for slidably receiving the housing such that the protrusion on the housing is received in the slot and an inner end of the tailpiece extends from the housing and casing. The protrusion is received in one of the two axially circumferential portions in the first backset position and in the second of the two axially spaced circumferential portions in the second backset position such that the casing is axially spaced relative to the latch bolt from the first backset position. The casing is rotatable relative to the housing, wherein relative axial movement between the casing and the housing is prevented when the protrusion is in either one of the two circumferential portions of the slot in a first relative rotational position of the housing in the first backset position and a second relative rotational position of the housing in the second backset position, and wherein relative axial movement of the casing relative to the housing is allowed in a third relative rotational position of the housing to allow the protrusion on the housing to be movable along the longitudinal passage between the circumferential portions of the slot when transitioning between the first backset position and the second backset position. The tool comprises a member comprising a first slot for receiving the inner end of the tailpiece and a pair of second slots for receiving the pair of ears such that rotation of the tool rotates the tailpiece and the casing simultaneously.

The pair of second slots may extend transversely relative to the first slot. The member may comprise a generally a rectangular elongated member. The member may comprise a generally cylindrically shaped member. The pair of second slots may terminate in short outwardly extending longitudinal portions. The slots may be positioned on the member such that when the tool is removed from the latch, the ears and the tailpiece are in the same relative position for engagement with a retractor of a lockset. The member may comprise a generally cylindrical hollow member closed by a wall at one end and open at the other end. The wall may be sized to receive the casing. The wall may define the pair of second slots comprising a pair of opposed longitudinal slots extending the length of the wall from the open end. Transversely extending tabs may provide leverage to the user for rotating the tool.

BRIEF DESCRIPTION OF THE DRAWINGS

For a more complete understanding of the cylindrical latch, reference should now be had to the embodiments shown in the accompanying drawings and described below. In the drawings.

DESCRIPTION

Figure 1:
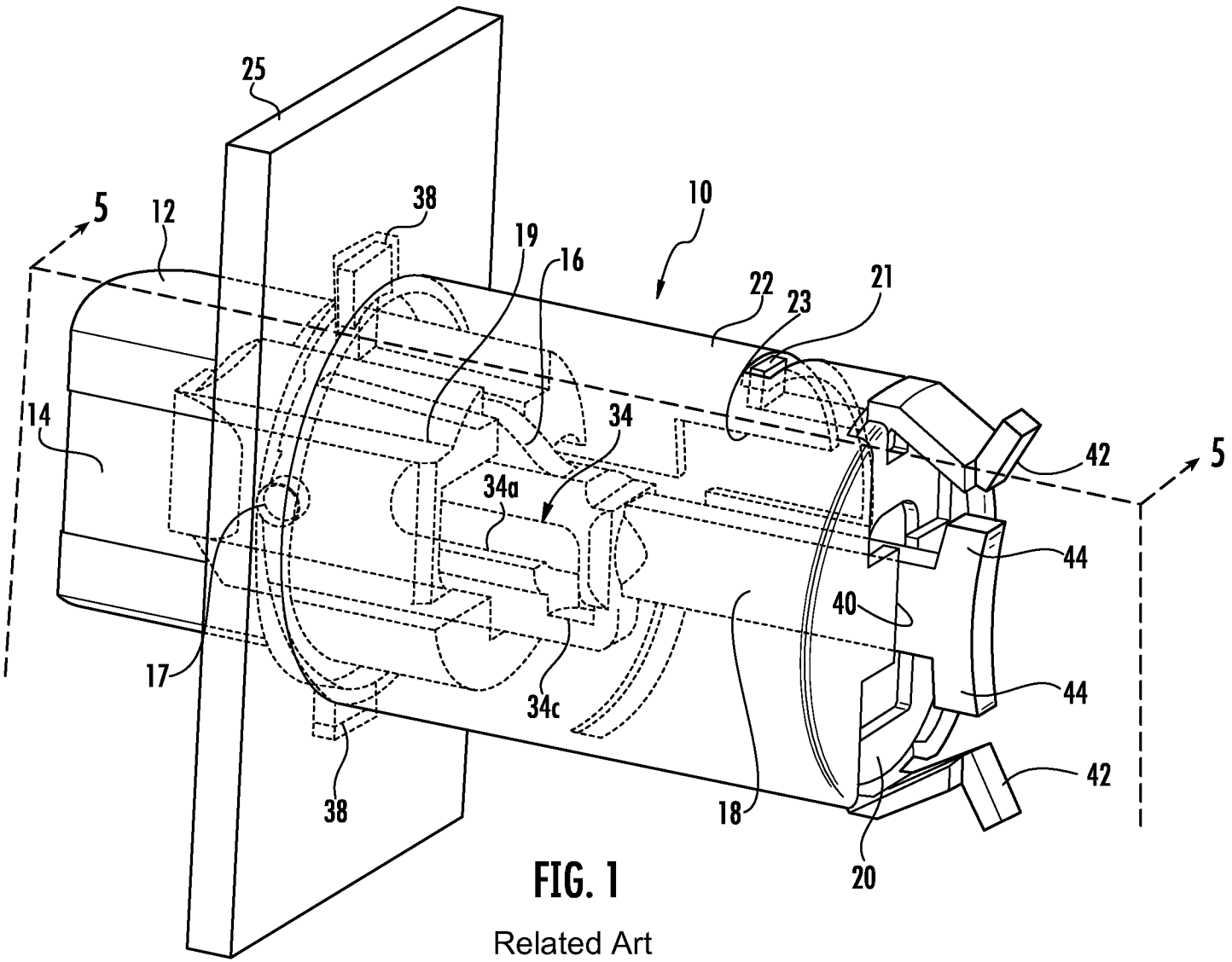
FIG. 1 Related Art
FIG. 1 is a rear perspective view of an embodiment of an adjustable backset cylindrical latch with which the tool of the invention may be used in a first position at a backset distance with a portion of the components shown in phantom.
Figure 2:
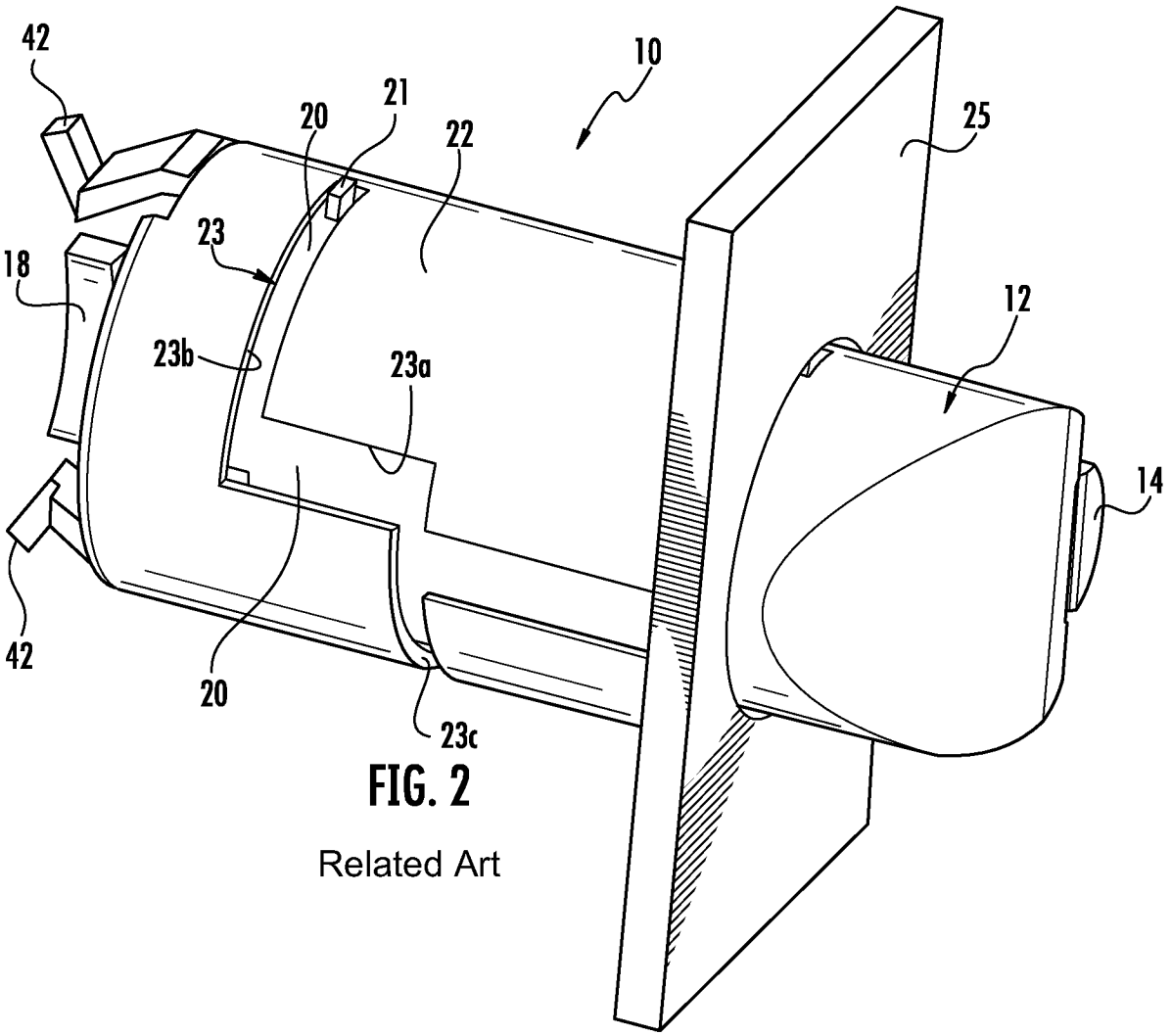
FIG. 2 Related Art
FIG. 2 is a front perspective view of the adjustable backset cylindrical latch as shown in FIG. 1.
Figure 3:
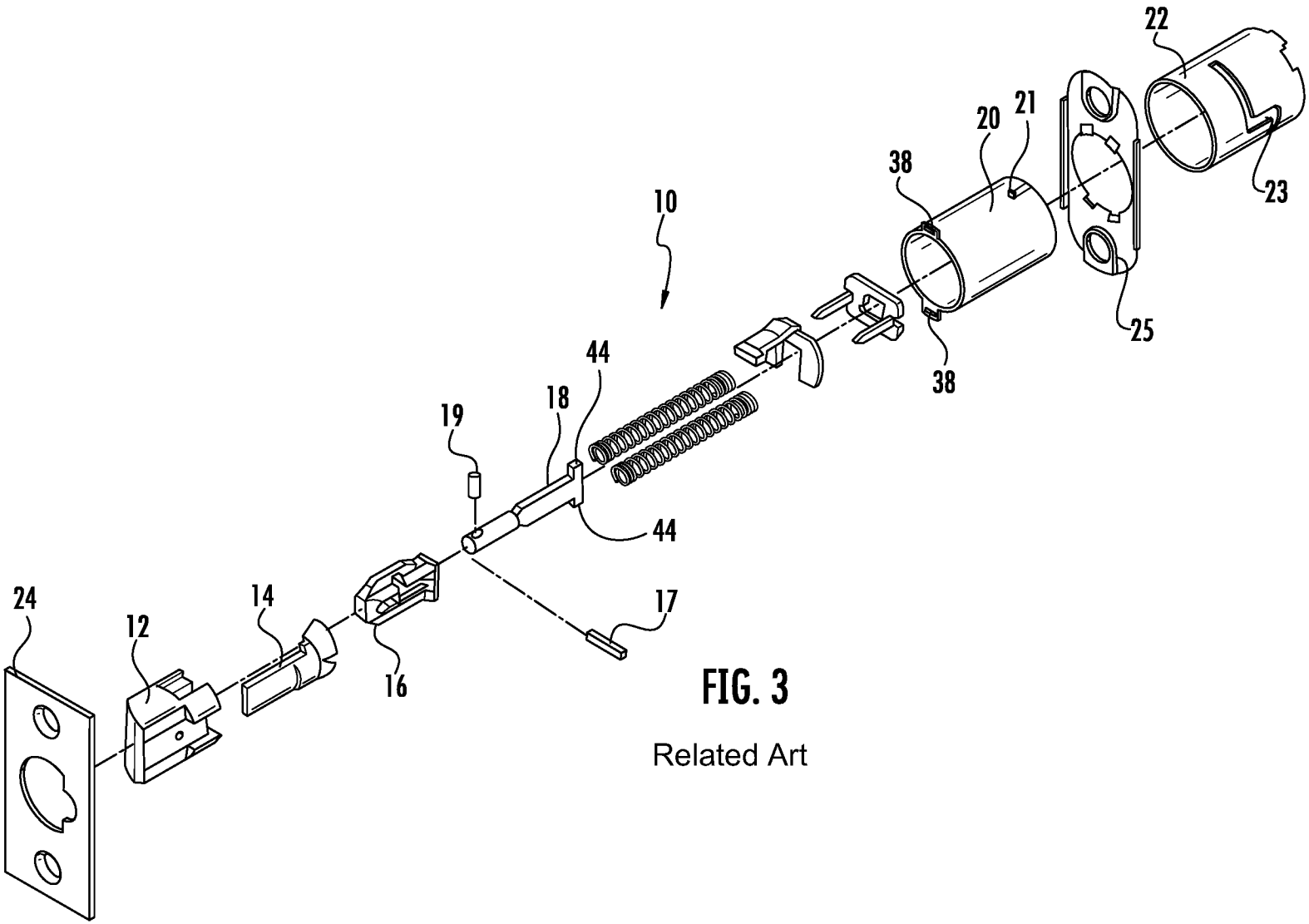
FIG. 3 Related Art
FIG. 3 is an exploded perspective view of the adjustable backset cylindrical latch as shown in FIG. 1.

The tool for changing backset of an adjustable lockset arrangement according to the present invention is for use in a conventional lockset such as, for example, the locksets described by U.S. Pat. Nos. 4,920,773, 6,131,970, and U.S. Patent Application No. 2017/0009490, the contents of which are incorporated herein by reference. An embodiment of a cylindrical latch assembly is shown in FIG. 1A and described in U.S. Patent Application No. 2017/0009490, which again the contents of which are incorporated herein by reference in their entirety. While an embodiment of an adjustable lockset is described herein, it is understood that the overall construction of the lockset assembly is not critical to the present invention and, for purposes of illustration, may be as described herein or in the above-referenced U.S. patents or the lockset may have another construction. Accordingly, although the present invention will be described in detail herein with reference to an exemplary embodiment of an adjustable backset function, detailed explanations of the functioning of all of the lock and lockset components are deemed unnecessary for understanding of the present invention by one of ordinary skill in the art.

Certain terminology is used herein for convenience only and is not to be taken as a limitation on the invention. For example, words such as "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

Referring now to the drawings, wherein like reference numerals designate corresponding or similar elements throughout the several views, an embodiment of an adjustable backset cylindrical latch assembly 10 for use with a conventional opening in a door (not shown) is shown in FIGS. 1 through 15. An embodiment of a tool for adjusting the backset of the latch according to the invention is generally designated at 100, 110 and 120. The latch 10 comprises a bolt head 12 which is configured to extend from a face plate 24 in the edge of a door. The bolt head 12 may include a deadlatch 14 slidably associated with the bolt head 12. The inner end of the bolt head 12 defines a longitudinal slot 30 for receiving an outer tailpiece 16. The outer end of the outer tailpiece 16 defines a short longitudinal slot 31 for receiving a transverse pin 17 for securing the bolt head 12 for movement together with the outer tailpiece 16.

The outer tailpiece 16 defines an inner cylindrical longitudinal bore 32 for slidingly receiving an outer end of an inner tailpiece 18. The bore 32 defines a slot 34 having a longitudinally extending intermediate portion 34*a*. The intermediate portion 34*a* terminates at each end in an outer transverse portion 34*b* and an inner transverse portion 34*c* extending transversely of the longitudinal portion 34*a* of the slot 34. A pin 19 is disposed in the outer end of the inner tailpiece 18. The pin 19 extends transversely from the outer end of the inner tailpiece 18.

The latch 10 is housed in an open-ended cylindrical inner case 20. The inner case 20 is fixed to the inner surface of the face plate 24 by a back plate 25. The back plate 25 captures opposed transverse tabs 38 between the face plate 24 and the back plate 25.

A cylindrical outer case 22 is configured to be slidably disposed on the inner case 20. The outer case 22 defines a slot 23 having a central longitudinal portion 23*a* interconnecting an inner circumferential portion 23*b* and an outer circumferential portion 23*c*. The inner case 20 has a radial external tab 21 extending into the slot 23 in the outer case 22.

Figure 16:
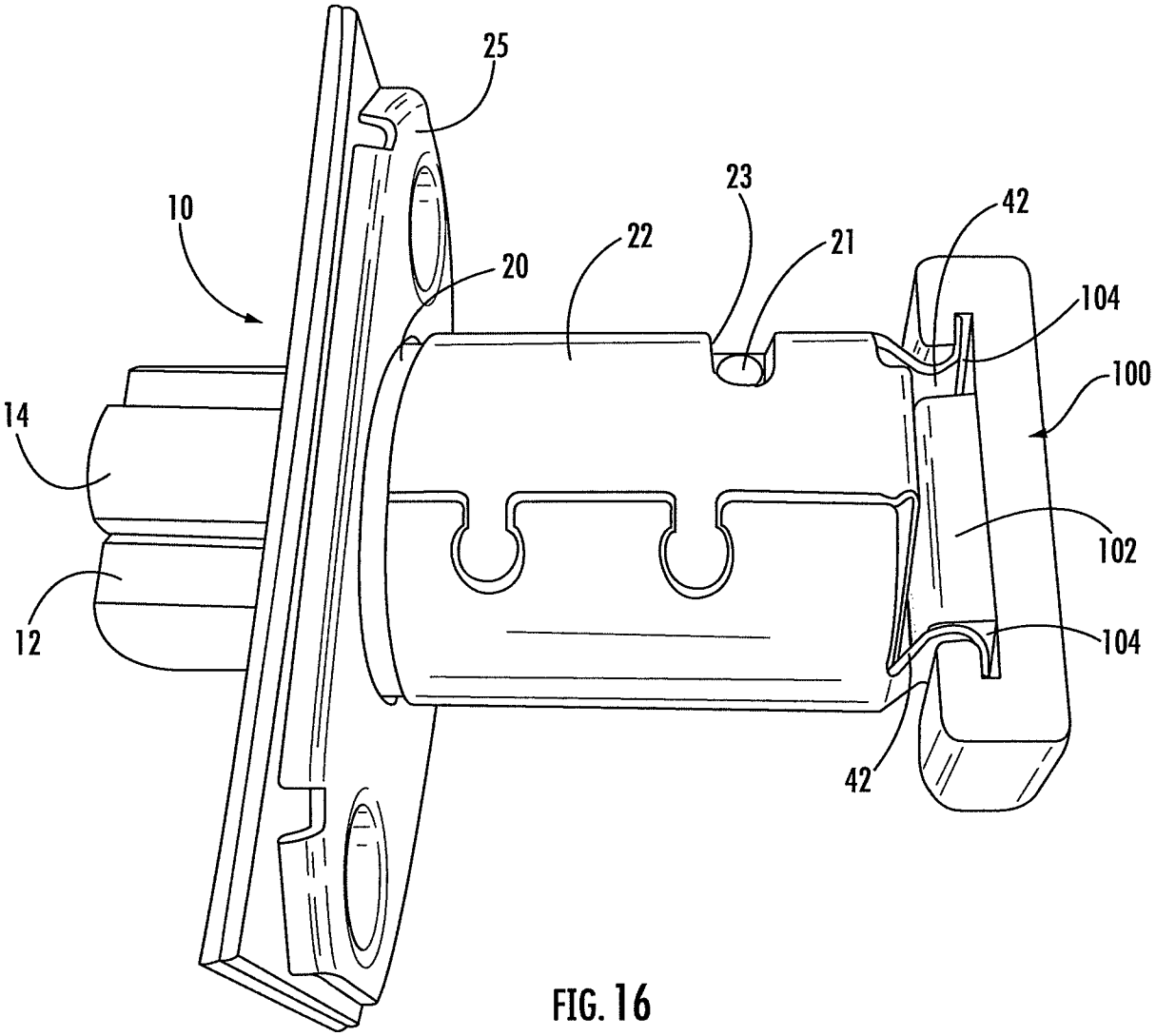
FIG. 16 is a bottom rear perspective view of an adjustable backset latch and an embodiment of a tool for adjusting a backset distance of the latch in a first backset position.
Figure 17:
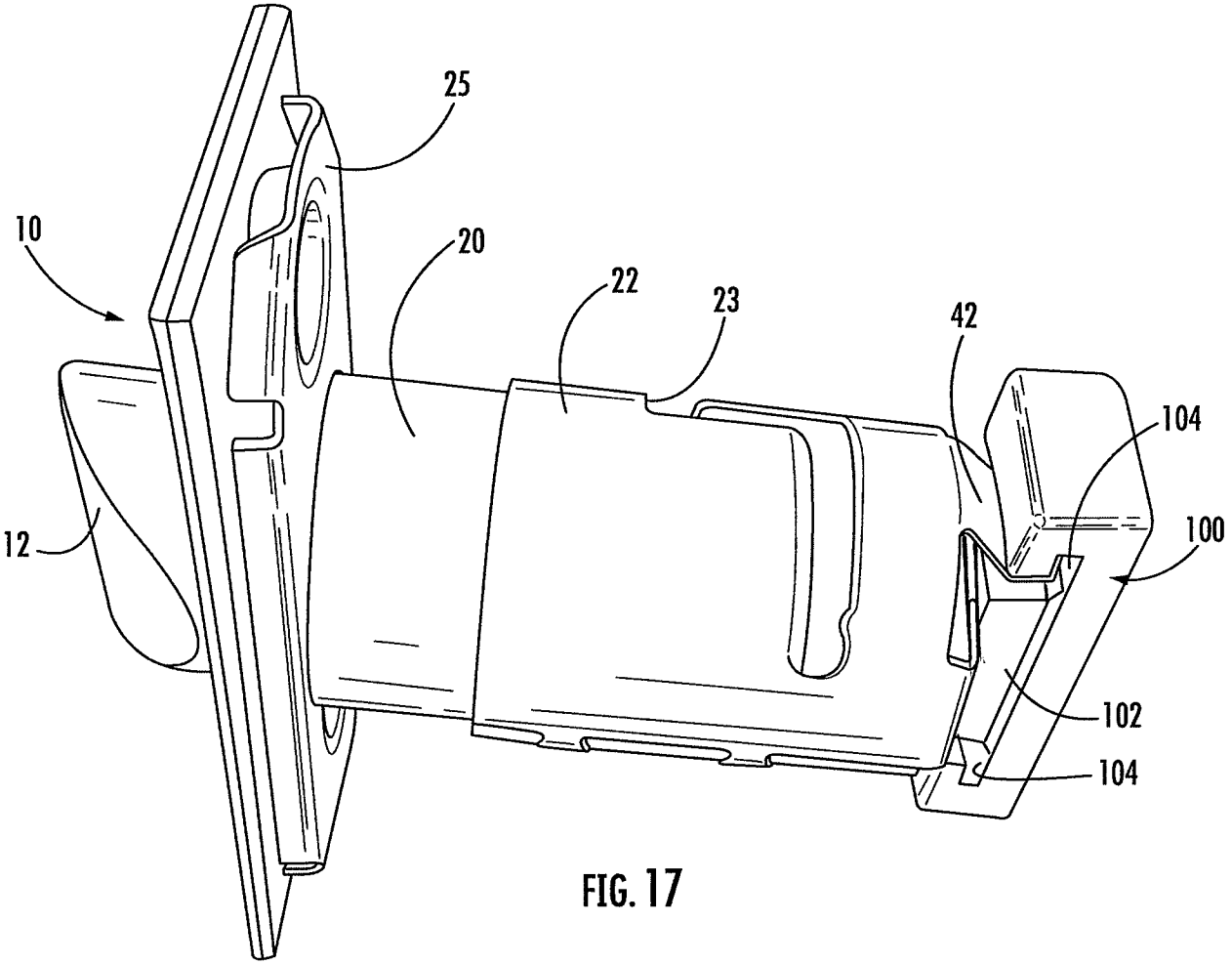
FIG. 17 is a top front perspective view of the adjustable backset latch and tool as shown in FIG. 16 in a second backset position.

FIGS. 1, 2, 4 and 5 show the latch 10 in a first backset position at 2⅜ inches. In this position, the outer end of the inner tailpiece 18 is fully inserted into the bore 32 in the outer tailpiece 16. The inner tailpiece 18 is rotated such that the end of the pin 19 is received in the outer transverse portion 34*b* of the slot 34 of the outer tailpiece 16. The bolt head 12 and the inner tailpiece 18 are secured for axial movement together particularly upon rotation of a latch operator 28 (FIG. 16) for retraction of the bolt head 12 into the inner case and opening of the door. In the first backset position, the tab 21 on the inner case 20 is at the end of the inner circumferential portion 23*b* of the slot 23 in the outer case 22.

Figure 6:
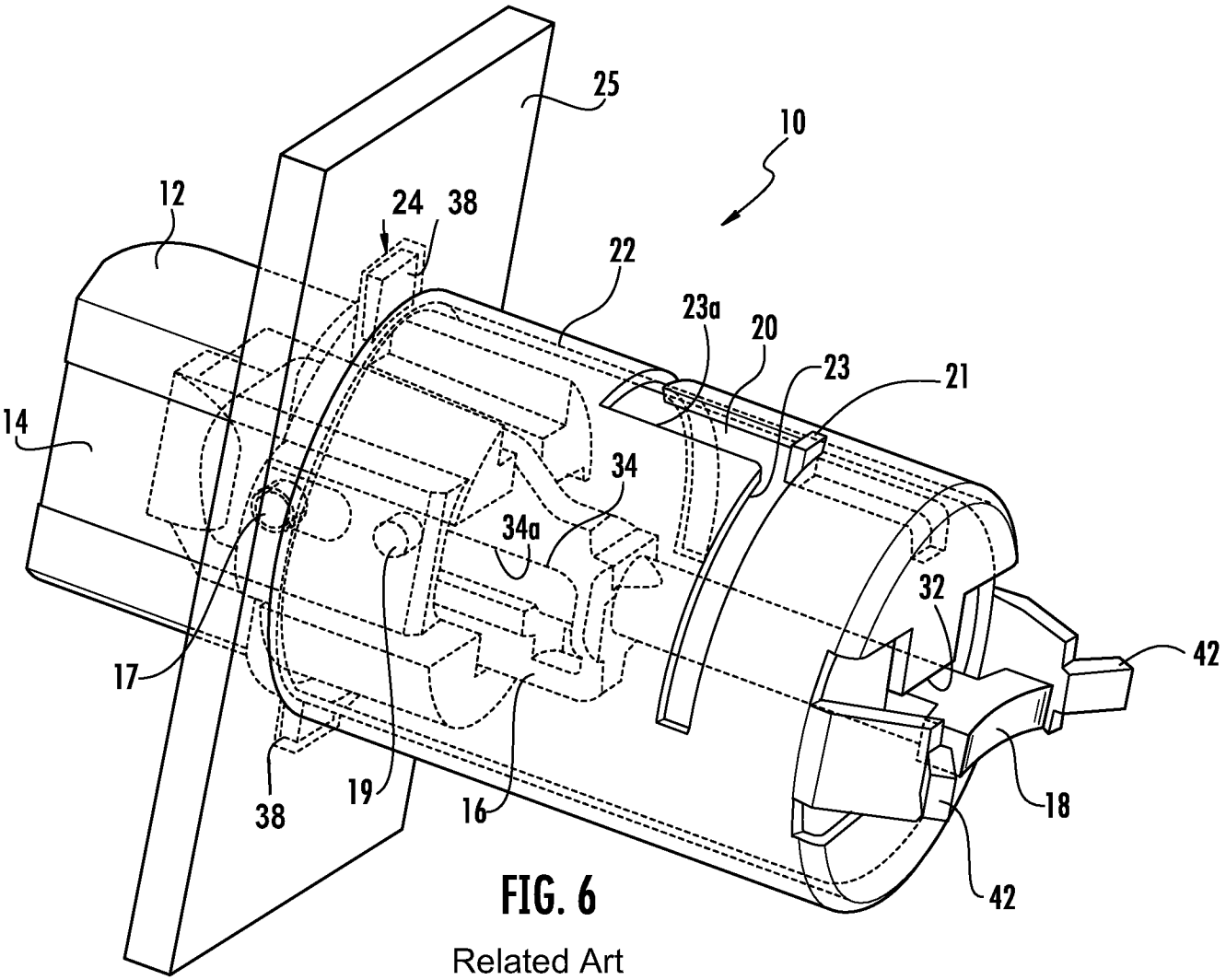
FIG. 6 Related Art
FIG. 6 is a rear perspective view of the adjustable backset cylindrical latch as shown in FIG. 1 in a second position with a portion of the components shown in phantom.
Figure 7:
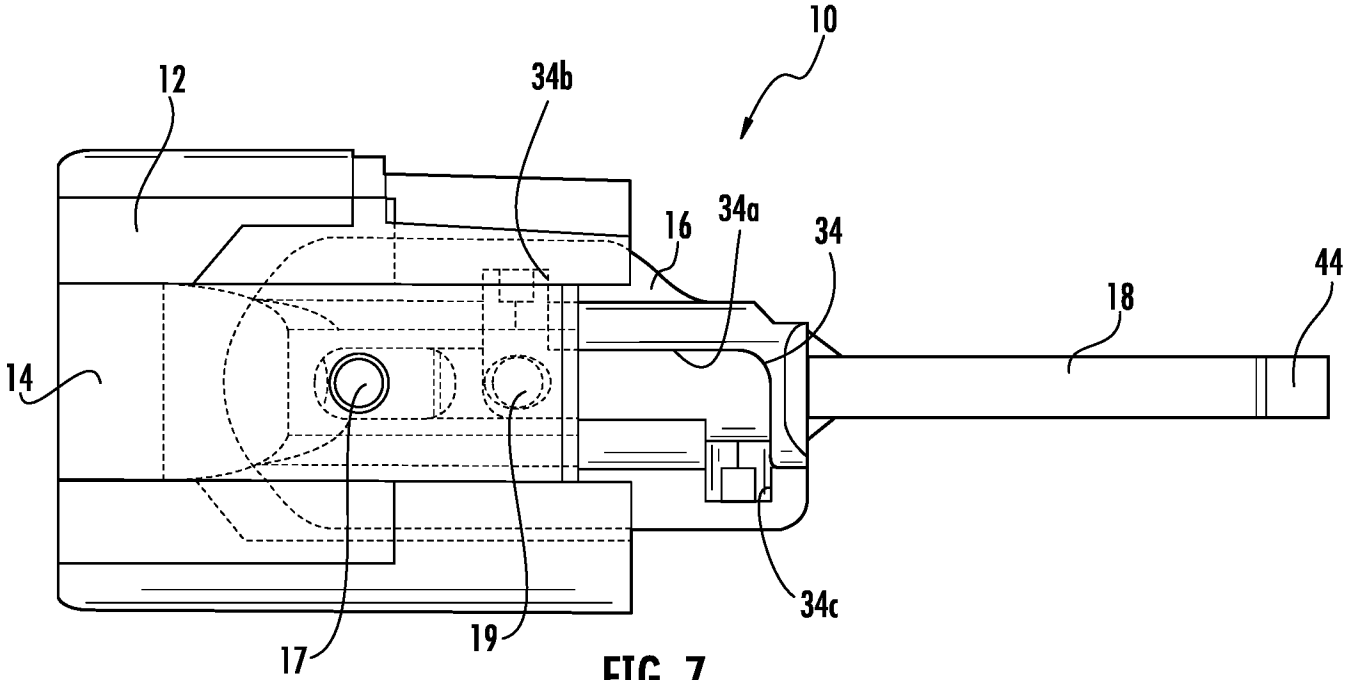
FIG. 7 Related Art
FIG. 7 is an elevation view of the cylindrical latch as shown in FIG. 4 in the second position.

To move the latch 10 to a second backset position, the inner tailpiece 18 and the outer case 22 are first rotated 90° counterclockwise to a position shown in FIGS. 6 and 7. As best shown in FIG. 1, the outer case 22 defines an inner opening 40 configured for non-rotatably passing the inner portion of the inner tailpiece 18. Thus, the inner tailpiece 18 and the outer case 22 rotate together to the 90° counterclockwise position. In this position, the pin 19 in the outer end of the inner tailpiece 18 is aligned with the longitudinal portion 34*a* of the slot 34 in the outer tailpiece 16. Similarly, the tab 21 on the inner case 20 is now aligned with the central longitudinal portion 23*a* of the slot 23 in the outer case 22 (FIG. 6). In this position, the inner tailpiece 18 and the outer case 22 are slidable in an axial direction relative to the outer tailpiece 16 and the inner case 20, respectively.

Figure 8:
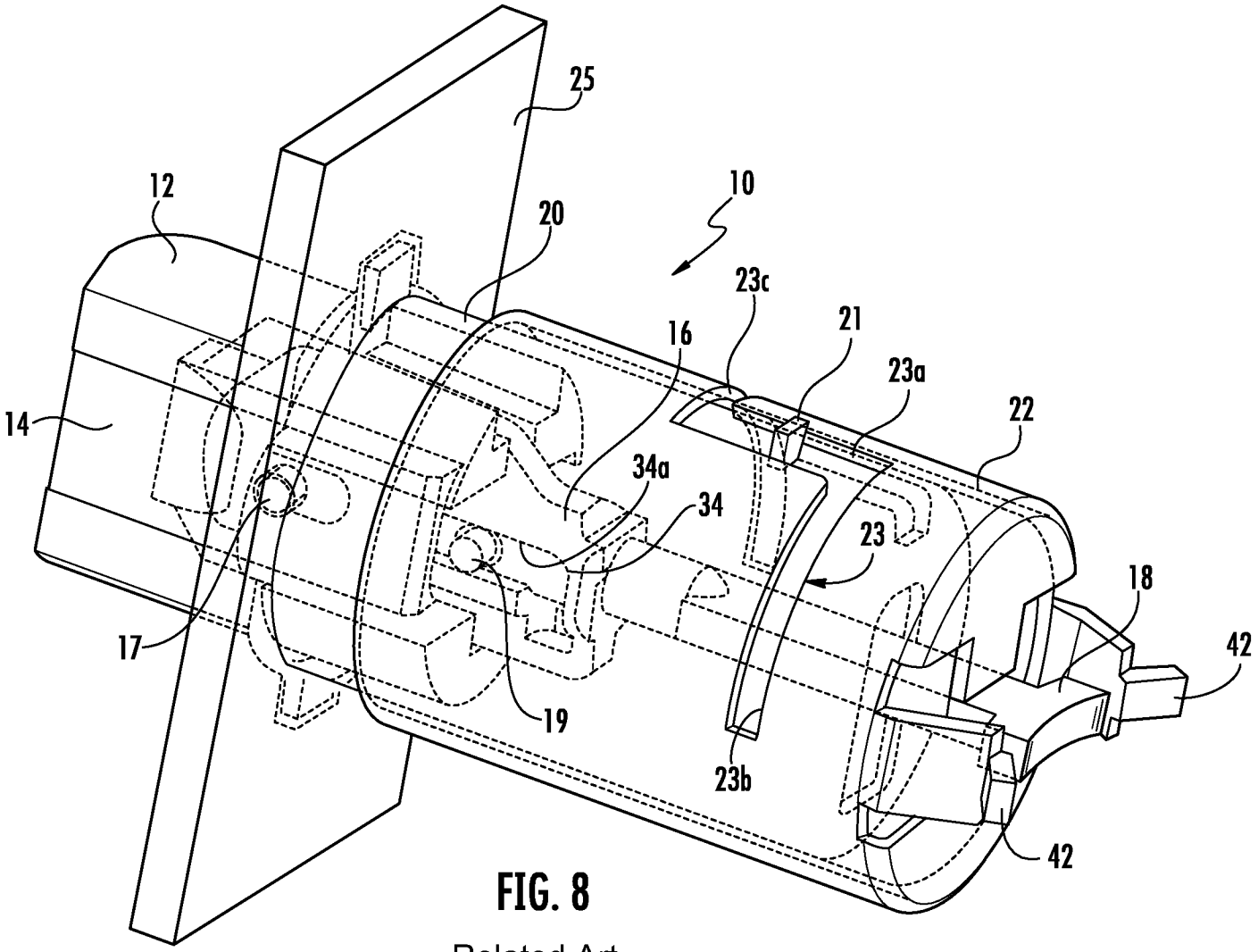
FIG. 8 Related Art
FIG. 8 is a rear perspective view of the adjustable backset cylindrical latch as shown in FIG. 1 in a third position with a portion of the components shown in phantom.
Figure 9:
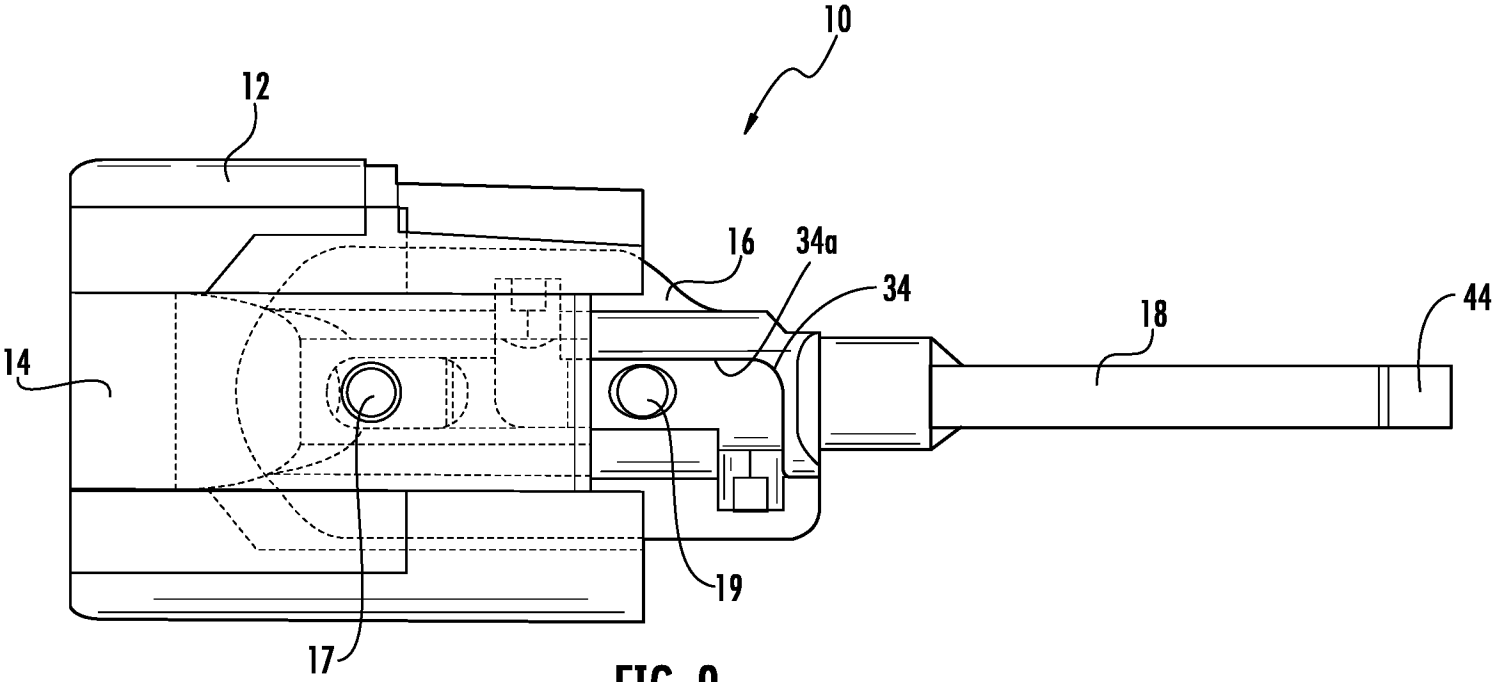
FIG. 9 Related Art
FIG. 9 is an elevation view of the cylindrical latch as shown in FIG. 4 in the third position.

FIGS. 8 and 9 show the inner tailpiece 18 with pin 19 partially advanced along the longitudinal portion 34*a* of the slot 34 towards the inner end of the bore 32 in the outer tailpiece 16. Accordingly, the tab 21 on the inner case 20 is partially advanced toward the outer circumferential portion 23*c* of the slot 23 in the outer case 22.

Figure 10:
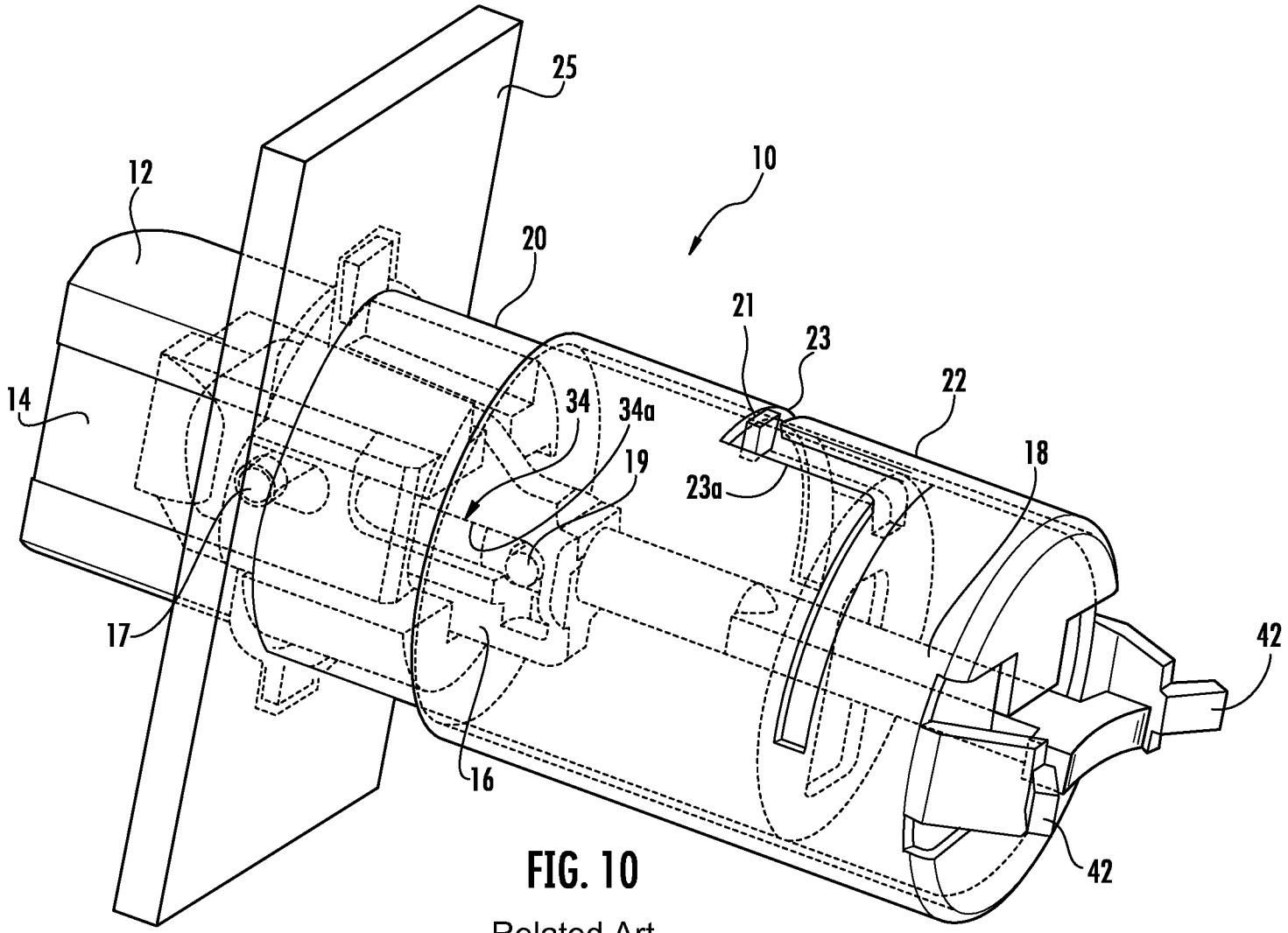
FIG. 10 Related Art
FIG. 10 is a rear perspective view of the adjustable backset cylindrical latch as shown in FIG. 1 in a fourth position with a portion of the components shown in phantom.
Figure 11:
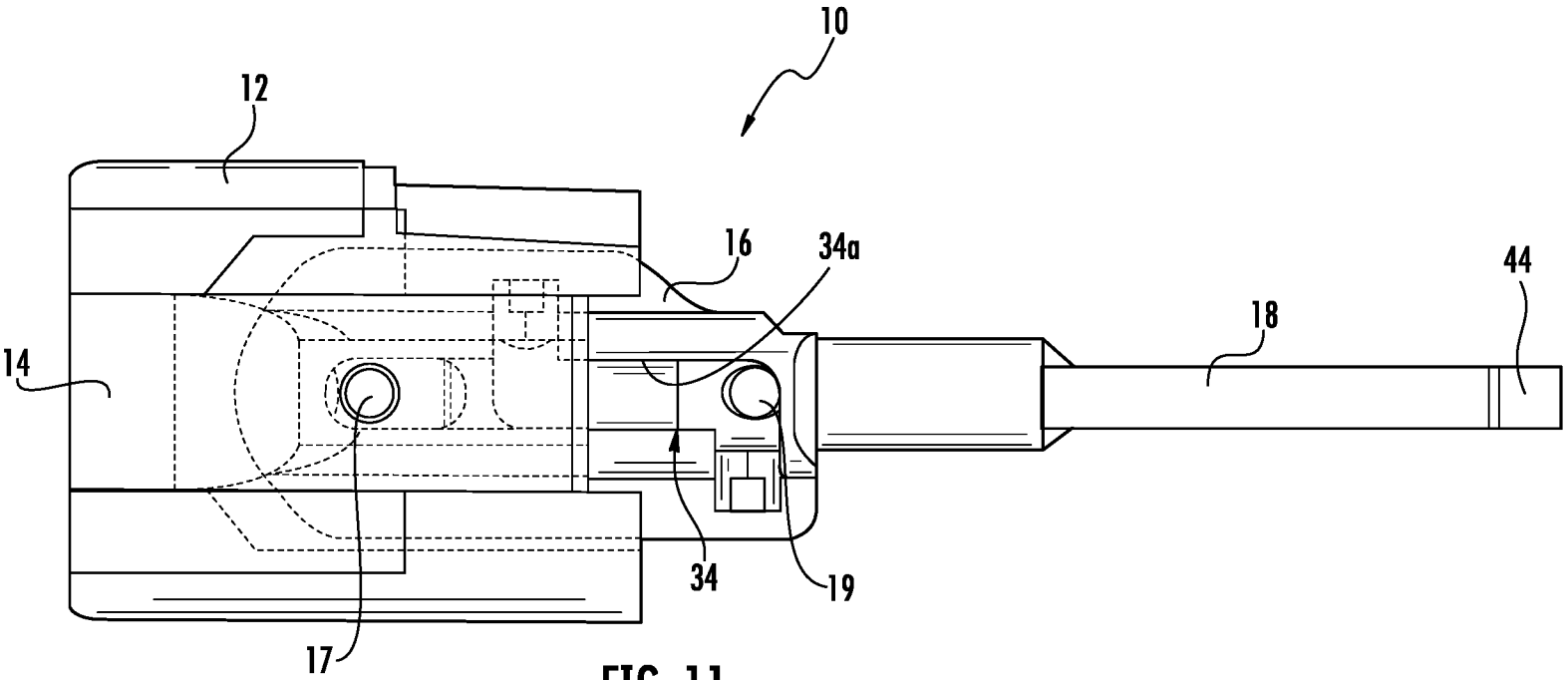
FIG. 11 Related Art
FIG. 11 is an elevation view of the cylindrical latch as shown in FIG. 4 in the fourth position.
Figure 12:
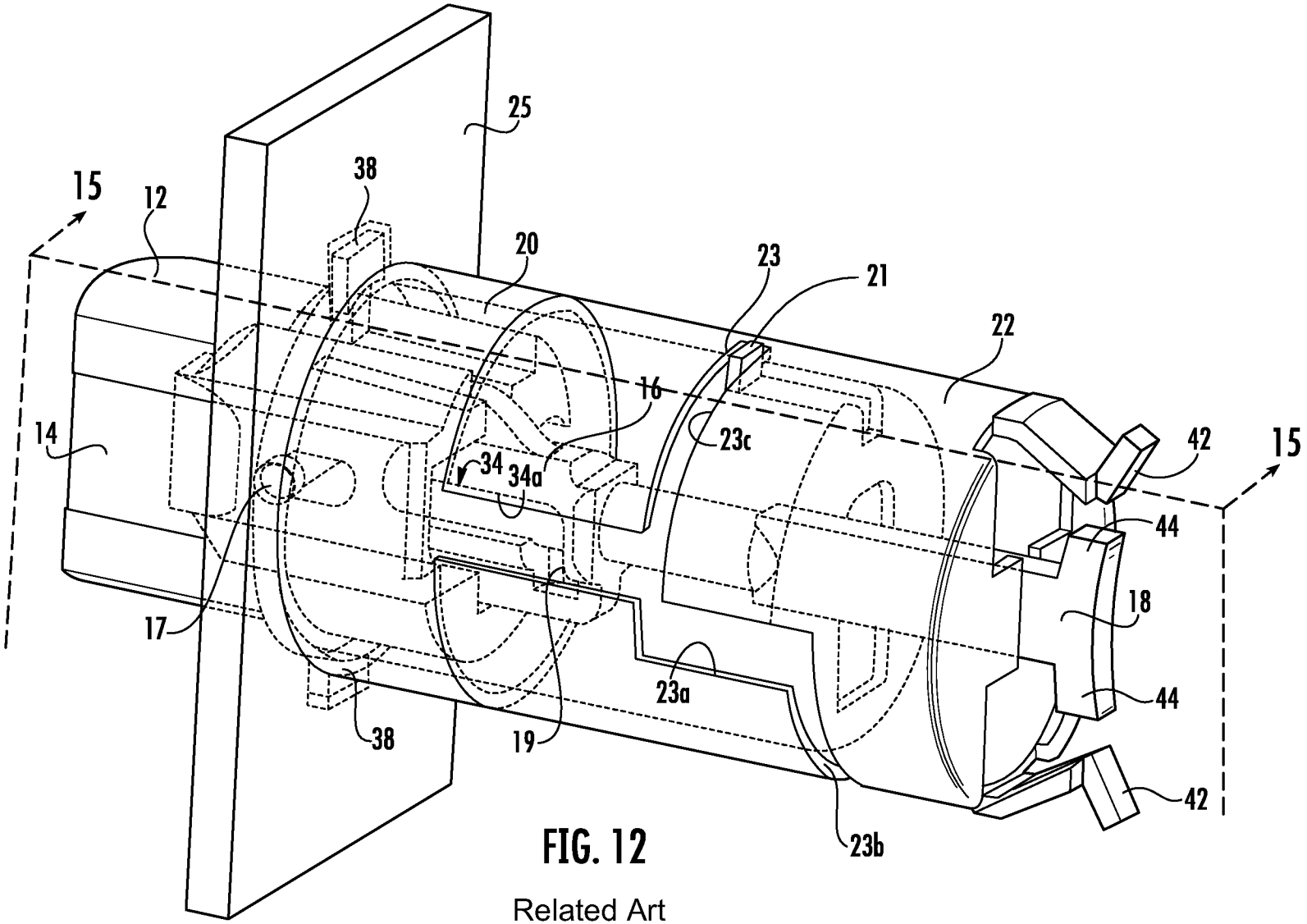
FIG. 12 Related Art
FIG. 12 is a rear perspective view of the adjustable backset cylindrical latch as shown in FIG. 1 in a fifth position at a second backset distance with a portion of the components shown in phantom.
Figure 13:
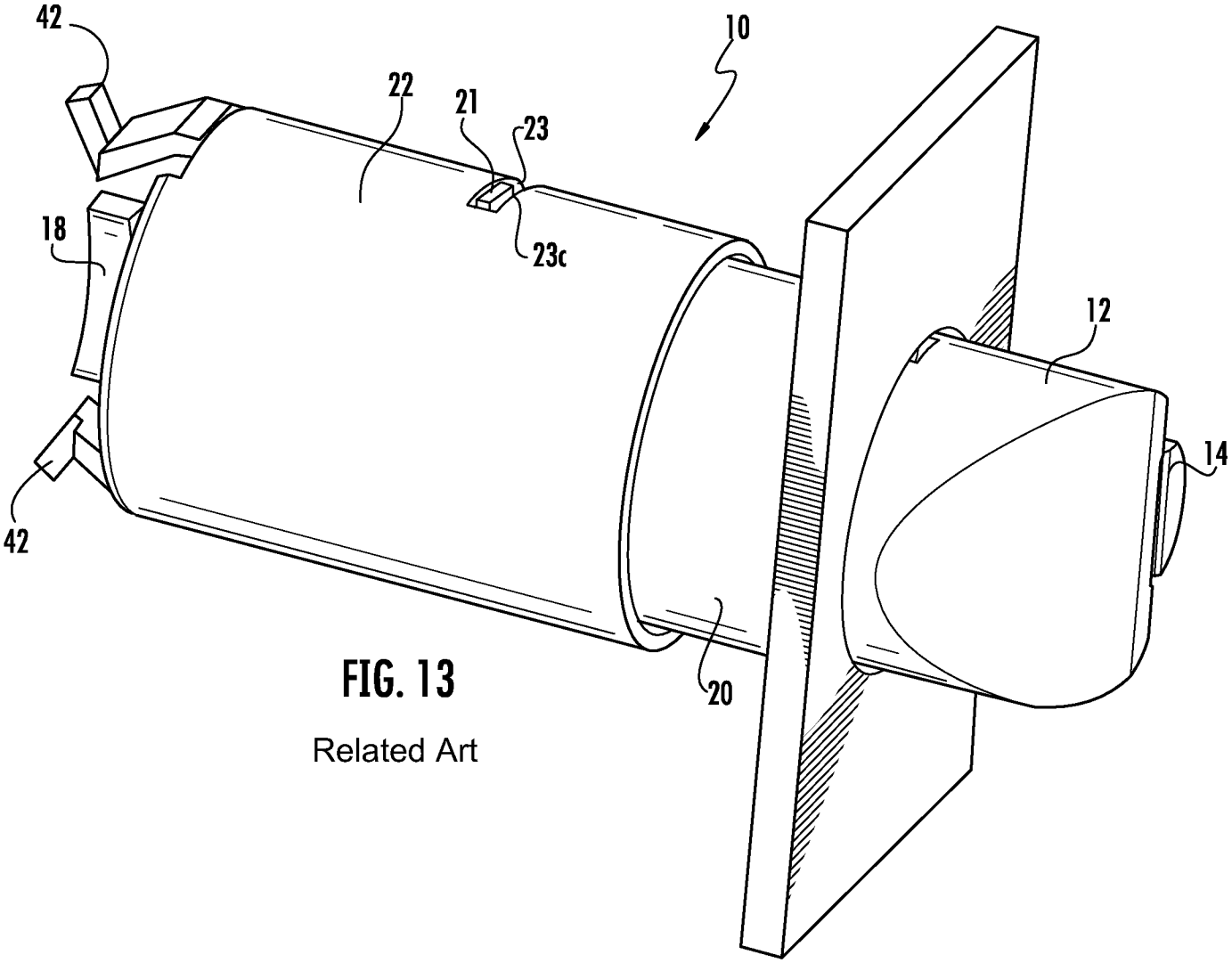
FIG. 13 Related Art
FIG. 13 is a front perspective view of the adjustable backset cylindrical latch as shown in FIG. 12.
Figure 14:
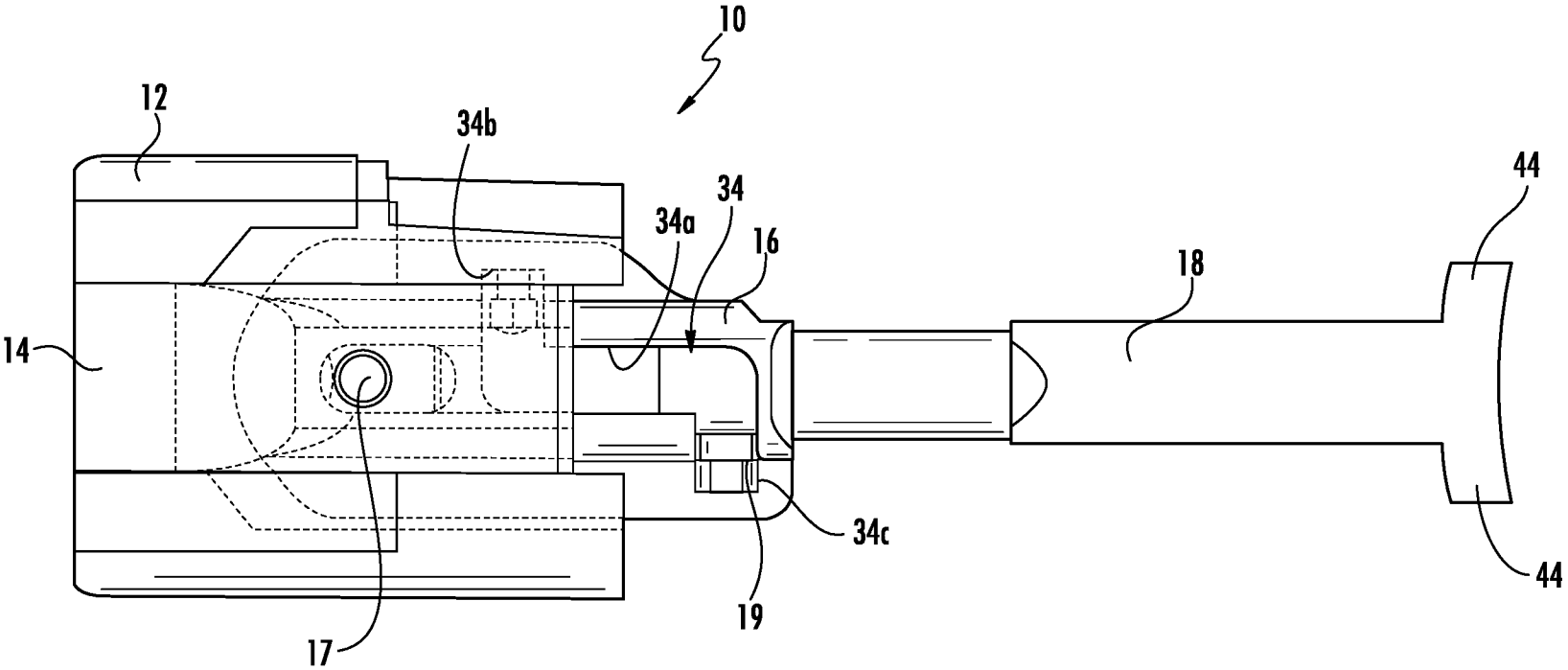
FIG. 14 Related Art
FIG. 14 is an elevation view of the cylindrical latch as shown in FIG. 4 in the fifth position.
Figure 15:
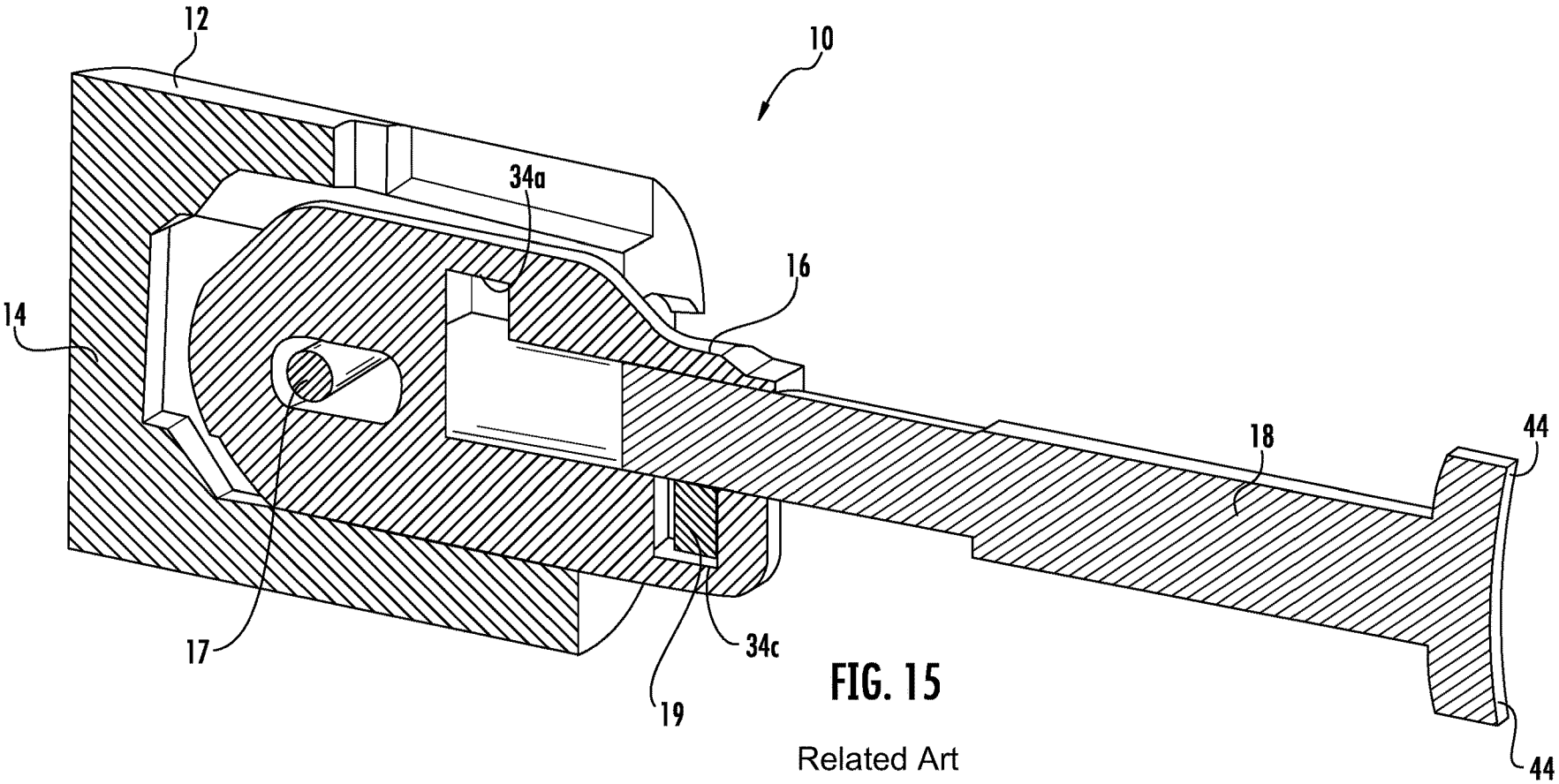
FIG. 15 Related Art
FIG. 15 is a perspective section view of the cylindrical latch as shown in FIG. 14 as taken along a vertical cutting plane 15-15 of FIG. 12 through the longitudinal axis of the cylindrical latch.

In FIGS. 10 and 11, the outer end of the inner tailpiece 18 is at the inner end of the bore 32 in the outer tailpiece 16 with pin 19 advanced to the end of longitudinal portion 34*a*. The tab 21 on the inner case 20 is at the inner end of the longitudinal portion 23*a* of the slot 23 in the outer case 22.

To complete movement of the latch 10 to the second backset position, the inner tailpiece 18 and the outer case 22 are rotated together 90° counterclockwise to the position shown in FIGS. 12-15. The pin 19 at the outer end of the inner tailpiece 18 is now in the inner transverse portion 34*c* of the slot 34 in the outer tailpiece 16. The tab 21 on the inner case 20 is disposed at the end of the outer circumferential slot 23*c* in the outer case 22. In this position, the backset distance is 2¾ inches, and the bolt head 12 and the inner tailpiece 18 are secured for axial movement together upon rotation of a latch operator 28.

Figure 4:
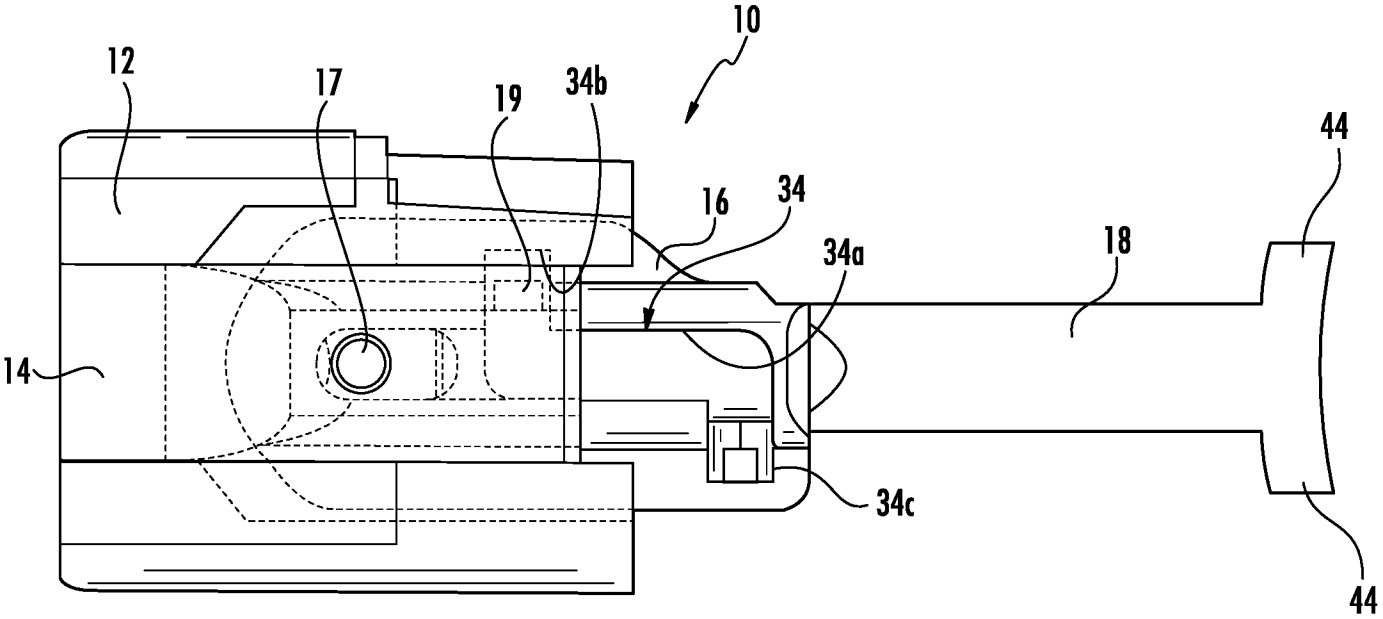
FIG. 4 Related Art
FIG. 4 is an elevation view of an embodiment of a cylindrical latch for use with the adjustable backset cylindrical latch as shown in FIG. 1.
Figure 5:
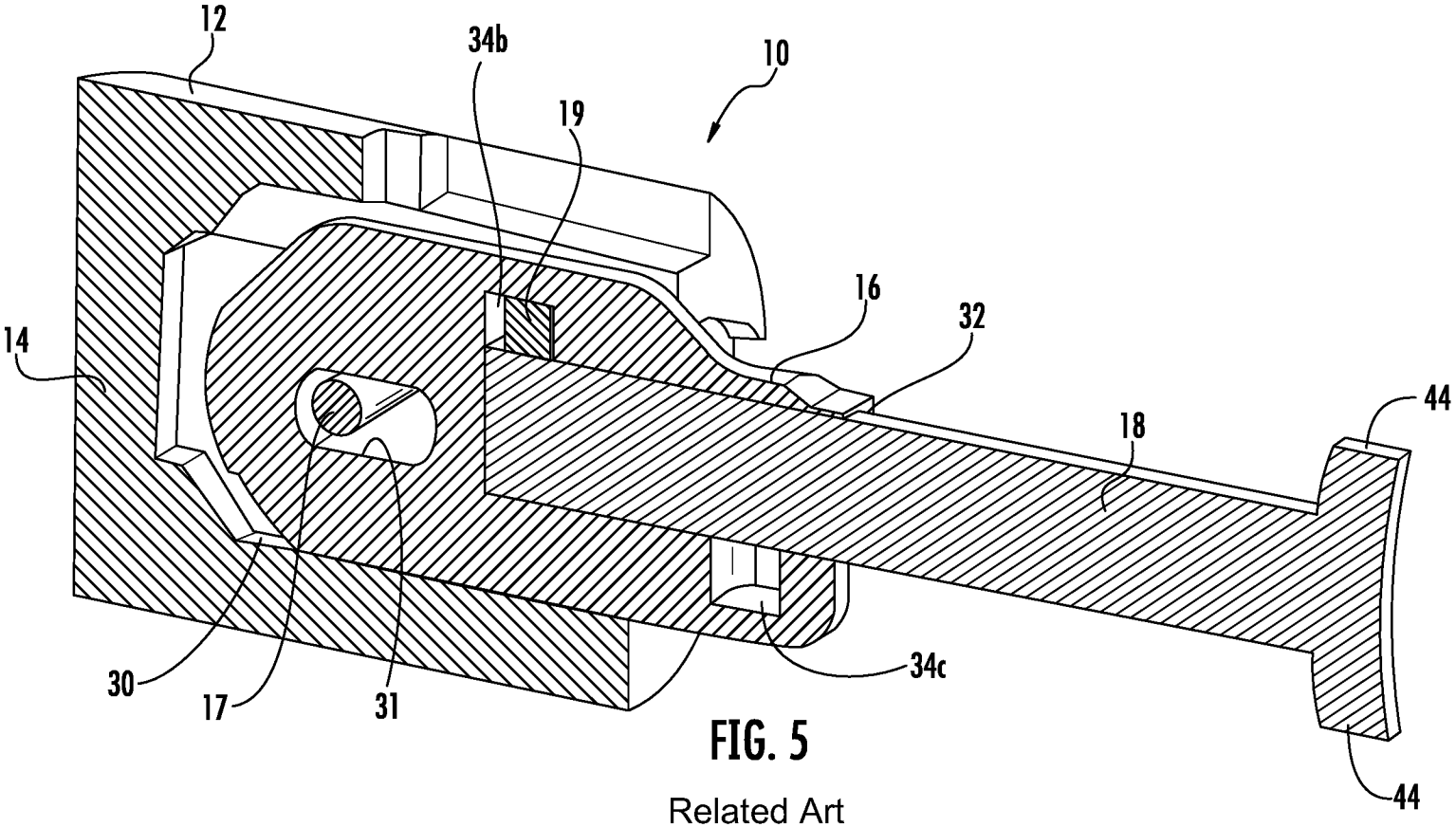
FIG. 5 Related Art
FIG. 5 is a perspective section view of the cylindrical latch as shown in FIG. 4 as taken along a vertical cutting plane 5-5 of FIG. 1 through the longitudinal axis of the cylindrical latch.

The latch assembly is adapted for being positioned within an opening in the edge of a door for operable connection to an internal chassis with a U-shaped retractor. The retractor conventionally has a pair of spaced parallel legs. The ends of the legs are formed with a pair of opposed jaws. The tailpiece 18 is designed to be positioned through opening of a retractor housing with the arms 44 located behind the jaws of the retractor. Opposed ears 42 on the outer case 22 fit behind corresponding inwardly bent flanges on the chassis for securing the outer case 22 to the chassis. This conventional arrangement is shown in FIGS. 4, 7 and 8 of U.S. Application. No. 2009/0152875. Another prior art arrangement for a commercial grade lockset is shown in U.S. Application No. 2010/0307207. The contents of both U.S. Application No. 2009/0152875 and U.S. Application No. 2010/0307207 are incorporated herein by reference in their entirety.

Various embodiments of the tool 100, 110 and 120 are shown for adjusting backset distance of the latch 10 in FIGS. 16-26. The tool comprises a member for connecting to the inner end of the tailpiece 18 and the ears 42 on the outer case 22. In the embodiment of tool 100 the member 100*a* is generally a rectangular elongated member (FIGS. 16 and 17) while in the embodiments of the tool 110 (FIGS. 18-20) and 120 (FIGS. 21-26) the members 110*a* and 122, respectively, are generally cylindrically shaped members. For this purpose, an intermediate portion 102 of the member 100*a* of tool 100 and an intermediate portion 122 of the member 110*a* of the tool 110 defines an elongated longitudinal recess or slot 94 that extends inwardly into the tool 100 and is configured to receive the inner end of the tailpiece 18. The intermediate portion 102 of the tool 100 is bordered by transverse slots 104 extending inwardly into the tool 100. The slots 104 terminate in short outwardly extending longitudinal portions. The slots 104 are configured to receive the ears 42 of the outer case 22. With the tool 100, 110, 120 in place on the latch assembly 10, the user can simultaneously rotate the tool 100 together with the tailpiece 18 and the outer case 22 relative to the inner case 20 for adjustment of the backset of the latch from one position to a second position as described above. When the tool 100, 110, 120 is removed, the ears 42 at the inner end of the outer case 22 and the inner end of the inner tailpiece 18 are in the same relative position for engagement with the retractor of the lockset.

Figure 18:
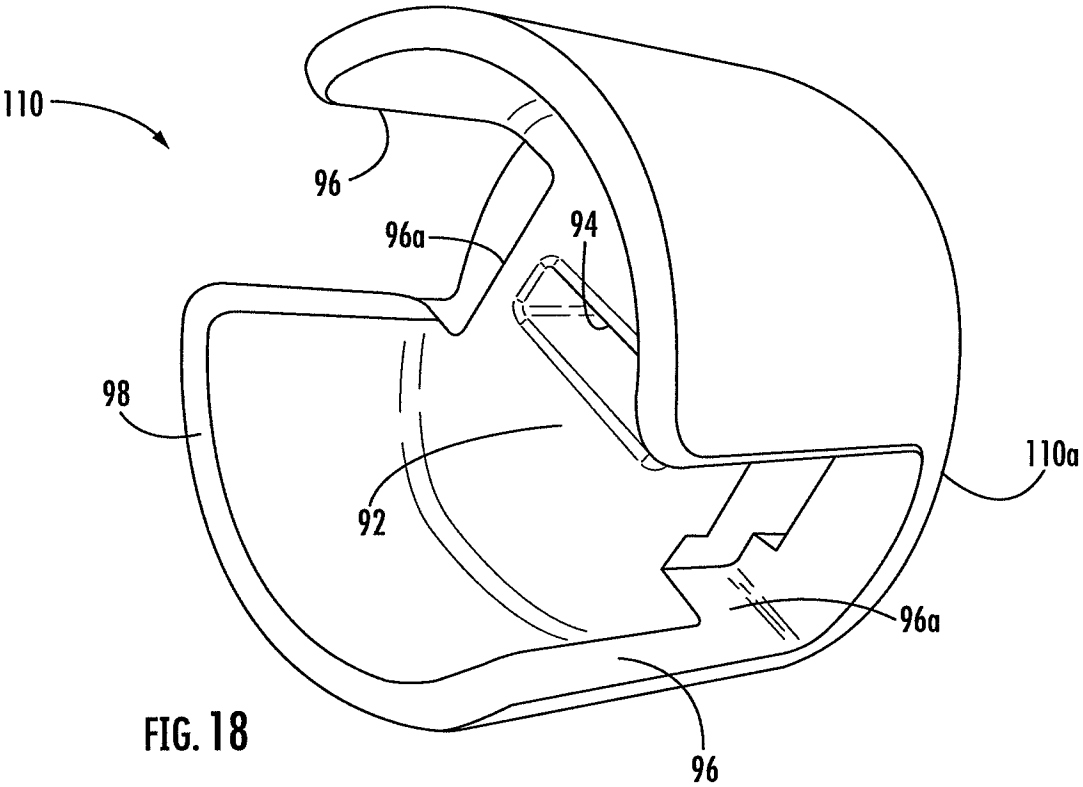
FIG. 18 is a front perspective view of a second embodiment of a tool for adjusting a backset distance of an adjustable backset latch.
Figure 19:
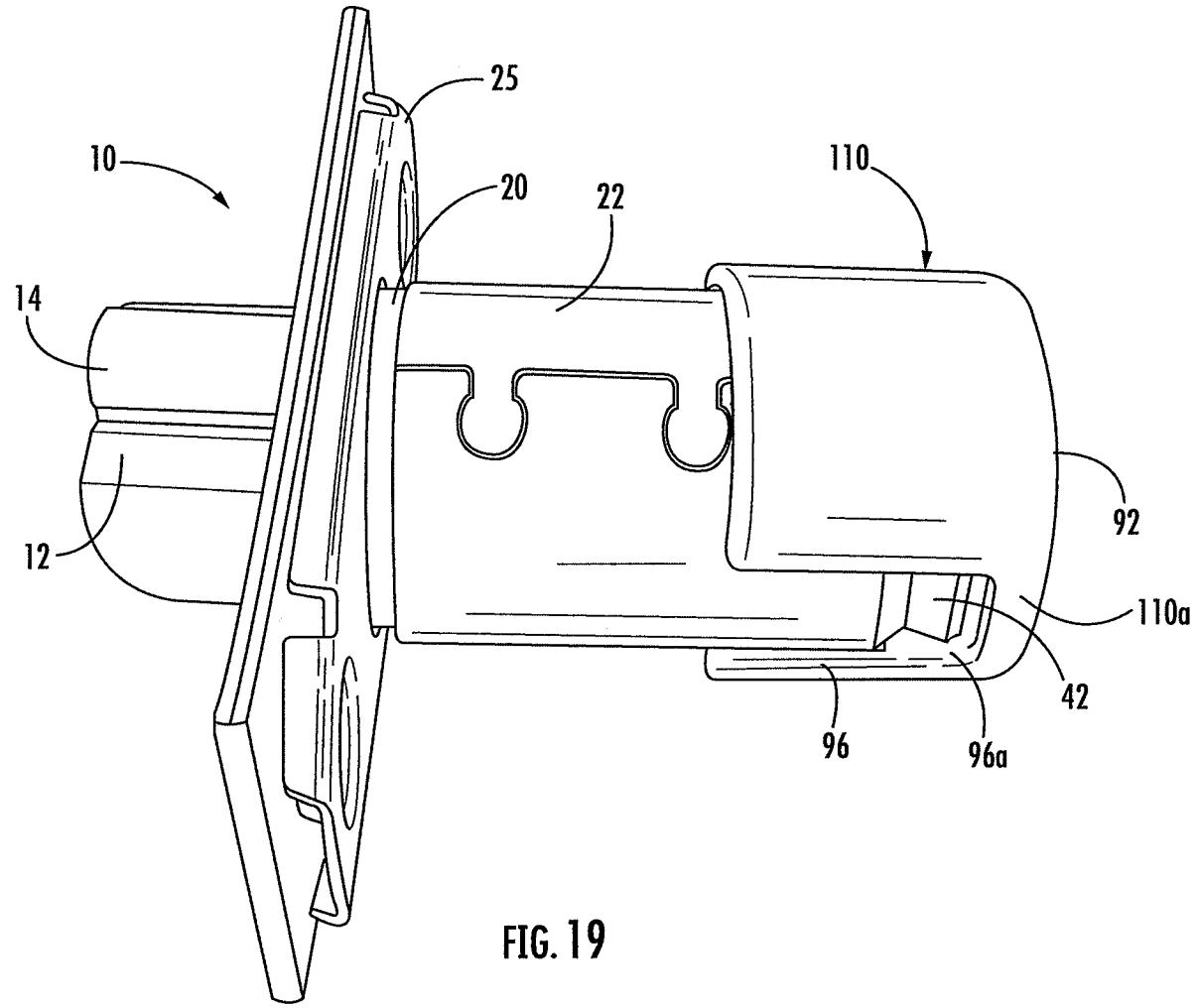
FIG. 19 is a bottom rear perspective view of an adjustable backset latch and the tool as shown in FIG. 18 in a first backset position.
Figure 20:
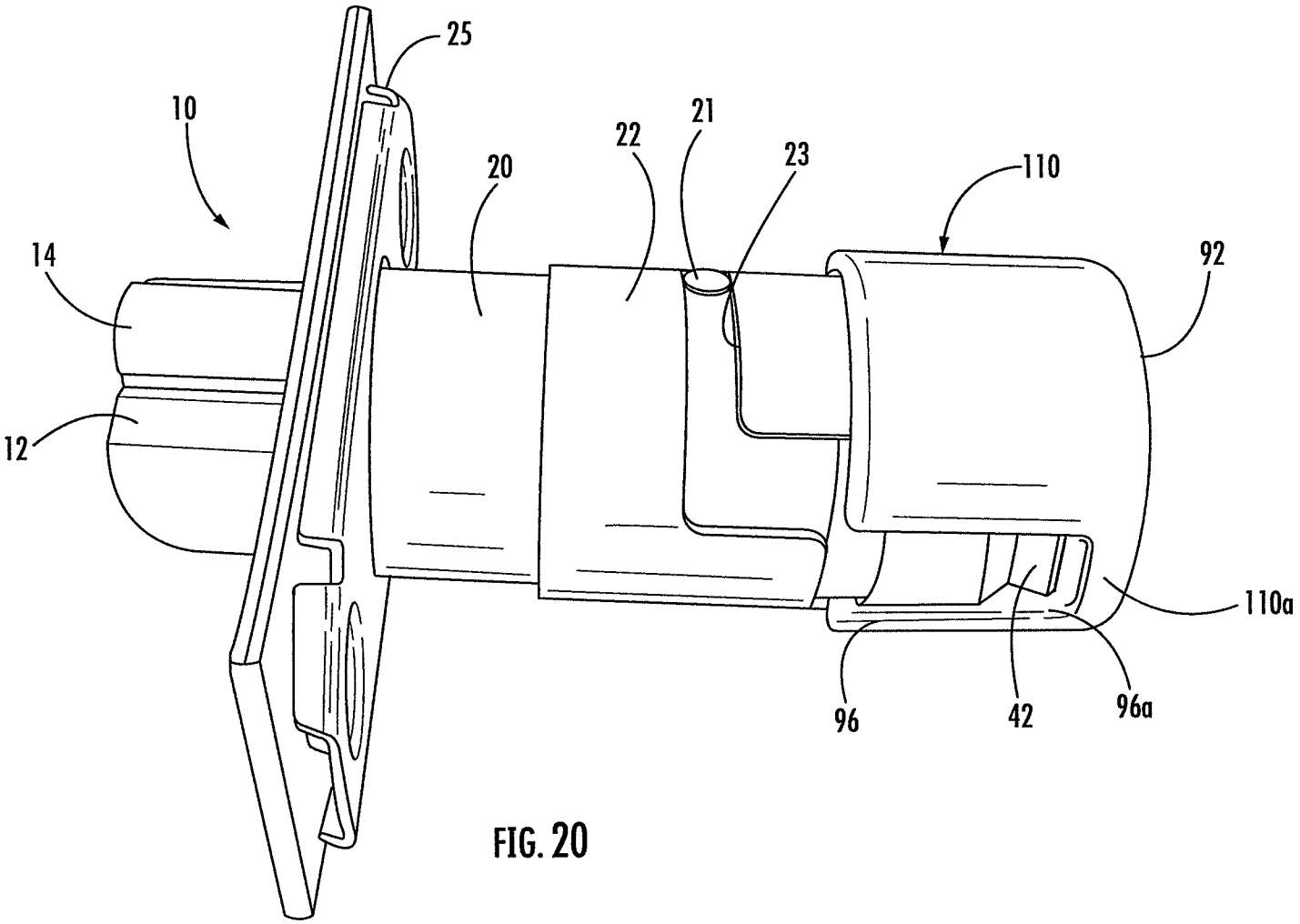
FIG. 20 is a photograph showing a top rear perspective view of the adjustable backset latch and tool as shown in FIG. 18 in a second backset position
Figure 21:
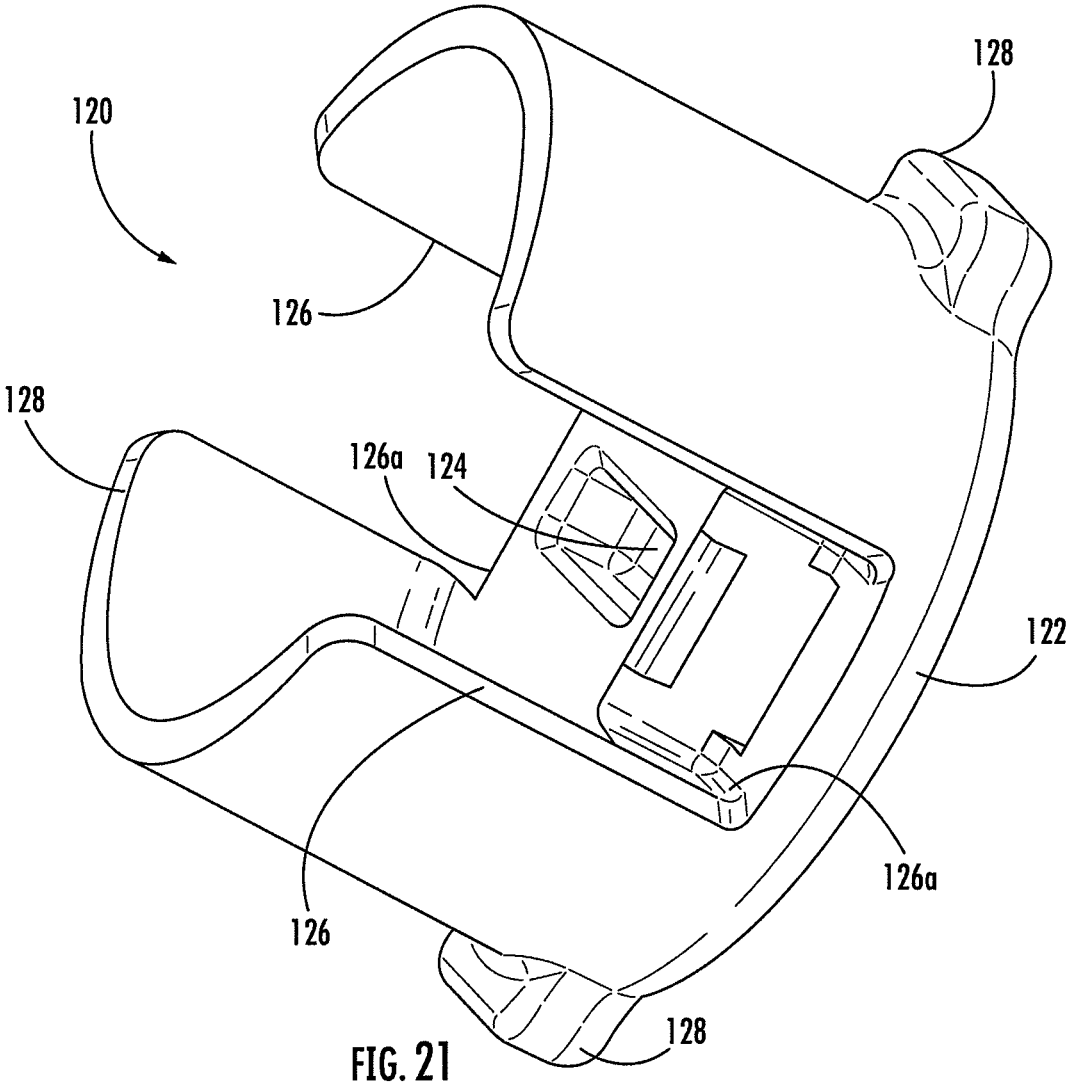
FIG. 21 is a side perspective view of a third embodiment of a tool for adjusting a backset distance of an adjustable backset latch.
Figure 22:
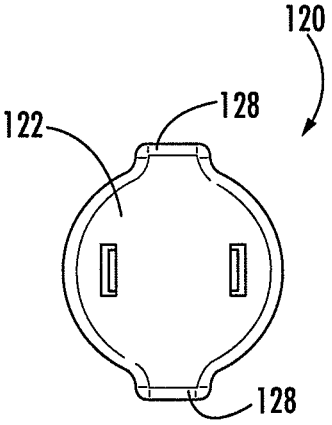
FIG. 22 is a rear elevation view of the tool as shown in FIG. 21.
Figure 23:
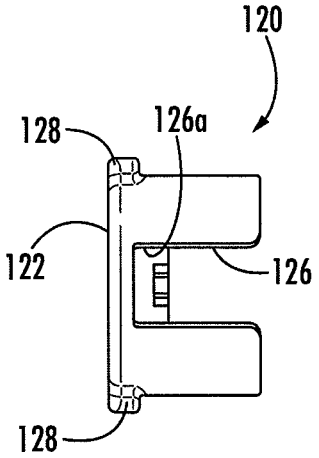
FIG. 23 is a side elevation view of the tool as shown in FIG. 21.
Figure 24:
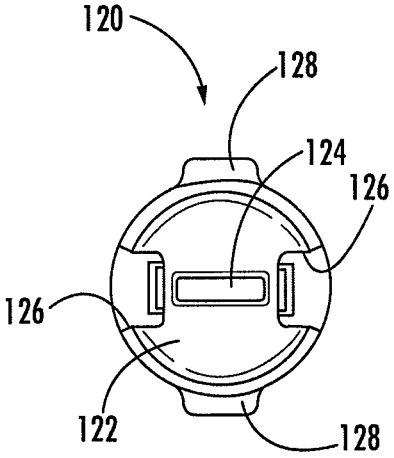
FIG. 24 is a front elevation view of the tool as shown in FIG. 21.
Figure 25:
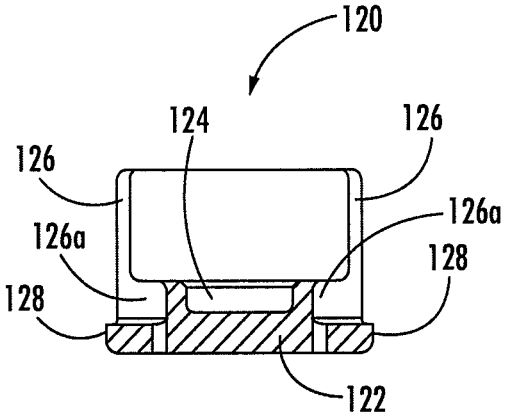
FIG. 25 is a transverse cross-section view of the tool as shown in FIG. 21 taken along line A-A of FIG. 24.
Figure 26:
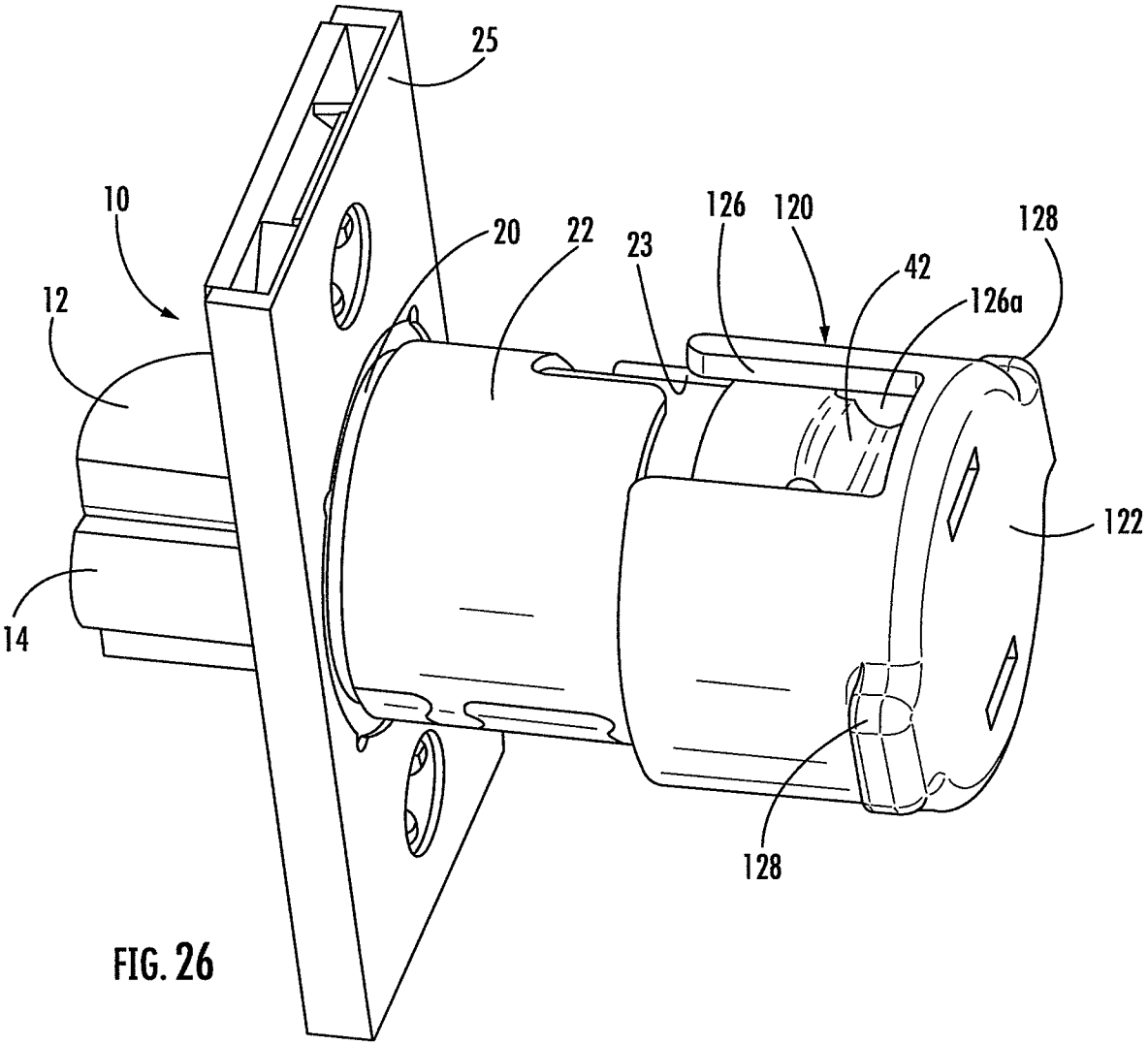
FIG. 26 is a top rear perspective view of an adjustable backset latch and the tool as shown in FIG. 21 in a first position.

The second embodiment of a tool for adjusting backset distance of the latch 10 as shown in FIGS. 18-20 and generally designated at 110. The tool 110 comprises a generally cylindrical hollow wall 98 closed by a wall or member 110*a* at one end and open at the other end. The tool 110 is sized to receive the inner end of the latch assembly 10. An inner surface of the wall or member 110*a* defines the elongated recess or slot 94. The tool 110 also has a pair of opposed slots 96 extending the length of the wall 98 of the tool 100 from the open end to the wall 110*a*. The slots 96 terminate in transverse slots or recesses 96*a* that receive ears 42. The slots 96 are configured to receive the ears 42 of the outer case 22 when the tool 110 is positioned over the end of the latch assembly 10. In this position of the tool 110, shown in FIGS. 19 and 20, the recess 94 receives the inner end of the tailpiece 18. With the tool 110 in place on the latch assembly 10, the user can simultaneously rotate the tool 110 with the tailpiece 18 and the outer case 22 relative to the inner case 20 for adjustment of the backset of the latch from one position to a second position as described above. When the tool 110 is removed, the ears 42 at the inner end of the outer case 22 and the inner end of the inner tailpiece 18 are in the same relative position for engagement with the retractor of the lockset.

A third embodiment of a tool for adjusting backset distance of the latch 10 is shown in FIGS. 21-26 and generally designated at 120. As with the second embodiment described herein, the tool 120 comprises a generally cylindrical hollow wall 128 closed by a wall or member 122 at one end and open at the other end. The tool 120 is sized to receive the inner end of the latch assembly 10. An inner surface of the wall or member 122 defines an elongated recess 124. The tool 120 also has a pair of opposed transverse slots 126 extending the length of the wall 128 from the open end to the wall or member 122. The slots 126 terminate in recesses 126*a* that are configured to receive the ears 42 of the outer case 22 when the tool 120 is positioned over the end of the latch assembly 10. In this position of the tool 120, shown in FIG. 26, the recess 124 receives the inner end of the tailpiece 18. With the tool 120 in place on the latch assembly 10, the user can simultaneously rotate the tool 120 with the tailpiece 18 and the outer case 22 relative to the inner case 20 for adjustment of the backset of the latch from one position to a second position as described above. Opposed tabs 128 extending transversely from the closed end of the tool 120 provide leverage to the user for rotating the tool 120. When the tool 120 is removed, the ears 28 at the inner end of the outer case 22 and the inner end of the inner tailpiece 18 are in the same relative position for engagement with the retractor of the lockset.

Although the adjustable backset cylindrical latch tool has been shown and described in considerable detail with respect to only a few exemplary embodiments thereof, it should be understood by those skilled in the art that we do not intend to limit the latch tool to the embodiments since various modifications, omissions and additions may be made to the disclosed embodiments without materially departing from the novel teachings and advantages, particularly in light of the foregoing teachings. Accordingly, we intend to cover all such modifications, omission, additions and equivalents as may be included within the spirit and scope of the latch tool as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A tool for adjusting a backset of a latch bolt assembly comprising a latch bolt, a tailpiece, and a housing for slidably receiving the latch bolt therein, the housing including a transversely extending protrusion; and a casing defining a peripheral slot having two axially spaced circumferential portions interconnected by a longitudinal portion, a pair of ears extending from the casing, the casing configured for slidably receiving the housing such that the protrusion on the housing is received in the slot and an inner end of the tailpiece extends from the housing and casing, the protrusion received in one of the two axially circumferential portions of the slot in a first backset state of the latch bolt assembly and received in a second of the two axially spaced circumferential portions of the slot in a second backset state of the latch bolt assembly such that the casing is axially spaced relative to the latch bolt from the first backset state, the casing being rotatable relative to the housing, wherein relative axial movement of the casing relative to the housing is prevented when the protrusion is in either one of the two axially spaced circumferential portions of the slot in a first relative rotational position of the casing in the first backset state and a second relative rotational position of the casing in the second backset state, and wherein relative axial movement of the casing relative to the housing is allowed in a third relative rotational position of the casing to allow the protrusion on the housing to be movable along the longitudinal portion of the slot between the two circumferential portions of the slot when transitioning between the first backset state and the second backset state, the tool comprising:

a member comprising a first slot for receiving the inner end of the tailpiece and a pair of second slots for receiving the pair of ears such that rotation of the tool rotates the tailpiece and the casing simultaneously, causing the rotation of the casing relative to the housing so as to adjust the backset of the latch bolt assembly.

2. The tool of claim 1 wherein the pair of second slots extend transversely relative to the first slot.

3. The tool of claim 1 wherein the member comprises a generally a rectangular elongated member.

4. The tool of claim 1 wherein the member comprises a generally cylindrically shaped member.

5. The tool of claim 1 wherein the pair of second slots terminate in short outwardly extending longitudinal portions.

6. The tool of claim 1 wherein the first slot and the pair of second slots are positioned on the member such that when the tool is removed from the latch, the ears and the tailpiece are in the same relative position for engagement with a retractor of a lockset.

7. The tool of claim 1 wherein the member comprises a generally cylindrical hollow member closed by a wall at one end and open at the other end.

8. The tool of claim 7 wherein the wall is sized to receive the casing.

9. The tool of claim 7 wherein the wall defines the pair of second slots, and the pair of second slots comprise a pair of opposed longitudinal slots extending the length of the wall from the open end.

10. The tool of claim 7 wherein the member further comprises transversely extending tabs to provide leverage to the user for rotating the tool.

11. A tool for adjusting a backset of a latch bolt assembly comprising a latch bolt, a tailpiece, and a housing for slidably receiving the latch bolt therein, the housing including a transversely extending protrusion; and a casing defining a slot, a pair of ears extending from the casing, the casing configured for slidably receiving the housing such that the protrusion on the housing is received in the slot and an inner end of the tailpiece extends from the housing and casing, wherein the casing is rotated relative to the housing to allow relative axial movement of the casing relative to the housing when transitioning the latch bolt assembly between a first backset state and a second backset state, the tool comprising:

a member comprising a first slot for receiving the inner end of the tailpiece and a pair of second slots for receiving the pair of ears such that rotation of the tool rotates the tailpiece and the casing simultaneously, causing the rotation of the casing relative to the housing so as to adjust the backset of the latch bolt assembly.

12. The tool of claim 11 wherein the pair of second slots extend transversely relative to the first slot.

13. The tool of claim 11 wherein the member comprises a generally a rectangular elongated member.

14. The tool of claim 11 wherein the member comprises a generally cylindrically shaped member.

15. The tool of claim 11 wherein the pair of second slots terminate in short outwardly extending longitudinal portions.

16. The tool of claim 11 wherein the first slot and the pair of second slots are positioned on the member such that when the tool is removed from the latch bolt assembly, the ears and the tailpiece are in the same relative position for engagement with a retractor of a lockset.

17. The tool of claim 11 wherein the member comprises a generally cylindrical hollow member closed by a wall at one end and open at the other end.

18. The tool of claim 17 wherein the wall is sized to receive the casing.

19. The tool of claim 17 wherein the wall defines the pair of second slots, and the pair of second slots comprise a pair of opposed longitudinal slots extending the length of the wall from the open end.

20. The tool of claim 17 wherein the member further comprises transversely extending tabs to provide leverage to the user for rotating the tool.

* * * * *